US008215406B2

(12) United States Patent
Dale et al.

(10) Patent No.: US 8,215,406 B2
(45) Date of Patent: Jul. 10, 2012

(54) WELLBORE METHOD AND APPARATUS FOR COMPLETION, PRODUCTION AND INJECTION

(75) Inventors: Bruce A. Dale, Sugar Land, TX (US); Michael D. Barry, The Woodlands, TX (US); Charles S. Yeh, Spring, TX (US); Jon Blacklock, Katy, TX (US); Darren F. Rosenbaum, Doha (QA); Michael T. Hecker, Tomball, TX (US); David C. Haeberle, Cypress, TX (US); Manh V. Phi, Houston, TX (US); Michael J. Siegman, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 608 days.

(21) Appl. No.: 12/086,572

(22) PCT Filed: Dec. 15, 2006

(86) PCT No.: PCT/US2006/047993

§ 371 (c)(1),
(2), (4) Date: Jun. 22, 2009

(87) PCT Pub. No.: WO2007/092082

PCT Pub. Date: Aug. 16, 2007

(65) Prior Publication Data

US 2009/0294128 A1 Dec. 3, 2009

Related U.S. Application Data

(60) Provisional application No. 60/765,023, filed on Feb. 3, 2006, provisional application No. 60/775,434, filed on Feb. 22, 2006.

(51) Int. Cl.
*E21B 47/04* (2012.01)

(52) U.S. Cl. ..... 166/369; 166/278; 166/51

(58) Field of Classification Search ..... 166/369, 166/278, 51
See application file for complete search history.

(56) References Cited

U.S. PATENT DOCUMENTS 3,963,076 A 6/1976 Winslow (Continued)

FOREIGN PATENT DOCUMENTS

JP 61001715 7/1986

(Continued)

OTHER PUBLICATIONS

"Constrictor™ Annular Barrier Tool", Easywell, brochure from Halliburton, 2006, 2 pages.

(Continued)

*Primary Examiner* — William P Neuder
(74) *Attorney, Agent, or Firm* — ExxonMobil Upstream Research Company Law Department

(57) ABSTRACT

A method, system and apparatus associated with the production of hydrocarbons are described. One apparatus includes a swellable packer element around a primary and a secondary flow path, wherein the packer is configured to block flow in a portion of a wellbore annulus. One method includes disposing sand control devices having shunt tubes and a packer within a wellbore adjacent to a subsurface reservoir. The packer is then set within an interval, which may be an open-hole section of the wellbore. With the packer set, gravel packing of the sand control devices in different intervals may be performed. Then, hydrocarbons are produced from the wellbore by passing hydrocarbons through the sand control devices with the different intervals providing zonal isolation. In some embodiments, intervals may be alternatively packed and plugged, wherein the plugged intervals are not packed. In addition, the method may also include disposing the sand control devices and packer into the wellbore in conditioned drilling fluid. The conditioned drilling fluid may be displaced adjacent to the sand control devices by a carrier fluid. Again, once the packer is set, the gravel packing the intervals with the carrier fluid having gravel may be performed.

21 Claims, 19 Drawing Sheets

U.S. PATENT DOCUMENTS

| | | | | |
|---|---|---|---|---|
| 4,401,158 | A | 8/1983 | Spencer et al. | |
| 5,343,949 | A | 9/1994 | Ross et al. | |
| 5,350,018 | A | 9/1994 | Sorem et al. | |
| 5,355,953 | A | 10/1994 | Shy et al. | |
| 5,396,954 | A | 3/1995 | Brooks | |
| 5,476,143 | A | 12/1995 | Sparlin et al. | |
| 5,515,915 | A | 5/1996 | Jones et al. | |
| 5,588,487 | A | 12/1996 | Bryant | |
| 5,803,177 | A | 9/1998 | Hriscu et al. | |
| 5,868,200 | A | 2/1999 | Bryant et al. | |
| 5,909,774 | A | 6/1999 | Griffith et al. | |
| 5,934,376 | A | 8/1999 | Nguyen et al. | |
| 5,971,070 | A | 10/1999 | Ross et al. | |
| 6,056,061 | A | 5/2000 | Ross et al. | |
| 6,059,032 | A | 5/2000 | Jones | |
| 6,059,033 | A | 5/2000 | Ross et al. | |
| 6,227,303 | B1 | 5/2001 | Jones | |
| 6,298,916 | B1 | 10/2001 | Tibbles et al. | |
| 6,446,729 | B1 | 9/2002 | Bixenman et al. | |
| 6,464,261 | B1 | 10/2002 | Dybevik et al. | |
| 6,516,882 | B2 | 2/2003 | McGregor et al. | |
| 6,575,251 | B2 | 6/2003 | Watson et al. | |
| 6,588,506 | B2 | 7/2003 | Jones | |
| 6,695,067 | B2 | 2/2004 | Johnson et al. | |
| 6,749,023 | B2 | 6/2004 | Nguyen et al. | |
| 6,766,862 | B2 | 7/2004 | Chatterji et al. | |
| 6,789,624 | B2 | 9/2004 | McGregor et al. | |
| 6,814,139 | B2 * | 11/2004 | Hejl et al. | 166/51 |
| 6,817,410 | B2 | 11/2004 | Wetzel et al. | |
| 6,986,390 | B2 | 1/2006 | Doane et al. | |
| 7,100,690 | B2 * | 9/2006 | Mullen et al. | 166/278 |
| 2003/0000700 | A1 | 1/2003 | Hailey, Jr. | |
| 2004/0003922 | A1 | 1/2004 | Bayne et al. | |
| 2004/0140089 | A1 | 7/2004 | Gunneroed | |
| 2004/0173350 | A1 * | 9/2004 | Wetzel et al. | 166/253.1 |
| 2005/0028977 | A1 | 2/2005 | Ward | |
| 2005/0039917 | A1 | 2/2005 | Hailey, Jr. | |
| 2005/0045329 | A1 | 3/2005 | Wetzel et al. | |
| 2005/0061501 | A1 | 3/2005 | Ward et al. | |
| 2005/0067170 | A1 | 3/2005 | Richard | |
| 2005/0082060 | A1 | 4/2005 | Ward et al. | |
| 2005/0082061 | A1 | 4/2005 | Nguyen et al. | |
| 2005/0092485 | A1 | 5/2005 | Brezinski et al. | |
| 2005/0103494 | A1 * | 5/2005 | McGregor et al. | 166/276 |
| 2005/0178562 | A1 | 8/2005 | Livingstone | |

FOREIGN PATENT DOCUMENTS

| | | | |
|---|---|---|---|
| WO | WO 01/42620 | A1 | 6/2001 |
| WO | WO 2004/046504 | A1 | 6/2004 |
| WO | WO 2004/079145 | A2 | 9/2004 |
| WO | WO 2004/094769 | A2 | 11/2004 |
| WO | WO 2005/031105 | A2 | 4/2005 |
| WO | WO 2007/092083 | A2 | 8/2007 |

OTHER PUBLICATIONS

"Equilizer™ Production Enhancement System", brochure from Baker Oil Tools, 2005, 6 pages, Houston, TX.
"Equilizer™ Production Management System", brochure from Baker Oil Tools, 1999, 2 pages, Houston, TX.
"MZ Alternate Path Multizone Packer", brochure from Schlumberger, Jan. 2004, 2 pages.
"Resflow™", 2003, brochure from Reslink™, 1 page.
Swellfix Zonal Isolation, 2006, 2 pages from website.
"Swellpacker™ Isolation System", 2006, 2 pages from website.
"Swellpacker™ Isolation System", brochure from Halliburton, 2006, 2 pages.
European Search Report No. 113624, dated Apr. 8, 2006, 4 pages.
European Search Report No. 113776, dated Apr. 8, 2006, 5 pages.
PCT International Search Report and Written Opinion, dated Oct. 31, 2007, 10 pages.
PCT International Search Report and Written Opinion, dated Oct. 31, 2007, 13 pages.

* cited by examiner

WELLBORE METHOD AND APPARATUS FOR COMPLETION, PRODUCTION AND INJECTION

CROSS REFERENCE TO RELATED APPLICATIONS

This application is the National Stage of International Application No. PCT/US06/47993, filed 15 Dec. 2006, which claims the benefit of U.S. Provisional Application No. 60/765,023, filed 3 Feb. 2006 and the benefit of U.S. Provisional Application No. 60/775,434, filed 22 Feb. 2006.

FIELD OF THE INVENTION

This invention relates generally to an apparatus and method for use in wellbores and associated with the production of hydrocarbons. Particularly, but not exclusively, this invention relates to a wellbore apparatus and method for providing zonal isolation with a gravel pack within a well.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

The production of hydrocarbons, such as oil and gas, has been performed for numerous years. To produce these hydrocarbons, a production system may utilize various devices, such as sand screens and other tools, for specific tasks within a well. Typically, these devices are placed into a wellbore completed in either a cased-hole or open-hole completion. In cased-hole completions, a casing string is placed in the wellbore and perforations are made through the casing string into subterranean formations to provide a flow path for formation fluids, such as hydrocarbons, into the wellbore. Alternatively, in open-hole completions, a production string is positioned inside the wellbore without a casing string. The formation fluids flow through the annulus between the subsurface formation and the production string to enter the production string.

However, when producing hydrocarbons from subterranean formations, operations become more challenging because of the location of certain subterranean formations. For example, some subterranean formations are located in intervals with high sand content in ultra-deep water, at depths that extend the reach of drilling operations, in high pressure/temperature reservoirs, in long intervals, at high production rate, and at remote locations. As such, the location of the subterranean formation may present problems, such as loss of sand control, that increase the individual well cost dramatically. That is, the cost of accessing the subterranean formation may result in fewer wells being completed for an economical field development. For example, loss of sand control may result in sand production at the surface, downhole equipment damage, reduced well productivity and/or loss of the well. Accordingly, well reliability and longevity become design considerations to avoid undesired production loss and expensive intervention or workovers for these wells.

Sand control devices are an example of a device used in wells to increase well reliability and longevity. Sand control devices are usually installed downhole across formations to retain solid material and allow formation fluids to be produced without the solid materials above a certain size. Typically, sand control devices are utilized within a well to manage the production of solid material, such as sand. The sand control device may have slotted openings or may be wrapped by a screen. As an example, when producing formation fluids from subterranean formations located in deep water, it is possible to produce solid material along with the formation fluids because the formations are poorly consolidated or the formations are weakened by downhole stress due to wellbore excavation and formation fluid withdrawal.

However, under the increasingly harsh environments, sand control devices are more susceptible to damage due to high stress, erosion, plugging, compaction/subsidence, etc. As a result, sand control devices are generally utilized with other methods, such as gravel packing or fluid treatments to manage the production of sand from the subterranean formation.

One of the most commonly used methods to control sand is a gravel pack. Gravel packing a well involves placing gravel or other particulate matter around a sand control device coupled to the production string to enhance sand filtration and formation integrity. For instance, in an open-hole completion, a gravel pack is typically positioned between the wall of the wellbore and a sand screen that surrounds a perforated base pipe. Alternatively, in a cased-hole completion, a gravel pack is positioned between a casing string having perforations and a sand screen that surrounds a perforated base pipe. Regardless of the completion type, formation fluids flow from the subterranean formation into the production string through at least two filter mechanisms: the gravel pack and the sand control device.

With gravel packs, inadvertent loss of a carrier fluid may form sand bridges within the interval being gravel packed. For example, in a thick or inclined production intervals, a poor distribution of gravel (i.e. incomplete packing of the interval resulting in voids in the gravel pack) may occur with a premature loss of liquid from the gravel slurry into the formation. This fluid loss may cause sand bridges that form in the annulus before the gravel pack has been completed. To address this problem, alternate flowpaths, such as shunt tubes, may be utilized to bypass sand bridges and distribute the gravel evenly through the intervals. For further details of such alternate flowpaths, see U.S. Pat. Nos. 5,515,915; 5,868,200; 5,890,533; 6,059,032; 6,588,506; 4,945,991; 5,082,052; 5,113,935; 5,333,688 and International Application Publication No. WO 2004/094784; which are incorporated herein by reference.

Utilizing alternate flow paths is highly beneficial, but creates design challenges in making up a production string, such as coupling a packer to a sand control device or other well tools. The packer prevents flow through the wellbore around the alternate flow path, while permitting flow within the alternate flow path and in many instances through a primary flow path in addition.

While the shunt tubes assist in forming the gravel pack, the use of shunt tubes may limit methods of providing zonal isolation with a gravel pack. For example, in an open-hole completion, packers are not installed when a gravel pack is utilized because it is not possible to form a complete gravel pack above and below the packer. Without a gravel pack, various problems may be experienced. For instance, if one of the intervals in a formation produces water, the formation may collapse or fail due to increased drag forces and/or dissolution of material holding sand grains together. Also, the water production typically decreases productivity because water is heavier than hydrocarbons and it takes more pressure to move it up and out of the well. That is, the more water produced the less pressure available to move the hydrocarbons, such as oil. In addition, water is corrosive and may cause severe equipment damage if not properly treated. Finally, because the water has to be disposed of properly, the production of water increases treating, handling and disposal costs.

This water production may be further compounded with wells that have a number of different completion intervals with the formation strength varying from interval to interval. Because the evaluation of formation strength is complicated, the ability to predict the timing of the onset of water is limited. In many situations reservoirs are commingled to minimize investment risk and maximize economic benefit. In particular, wells having different intervals and marginal reserves may be commingled to reduce economic risk. One of the risks in these configurations is that gas and/or water breakthrough in any one of the intervals threatens the remaining reserves in the other intervals of the well completion. Thus, the overall system reliability for well completions has great uncertainty for gravel packed wells.

Accordingly, the need exists for method and apparatus that provides zonal isolation within a gravel pack, such as an open-hole completion. Also, the need exists for a well completion apparatus and method that provides alternative flow paths for sand control devices, such as sand screens, and packers to gravel pack different intervals within a well.

Other related material may be found in at least U.S. Pat. No. 5,588,487; U.S. Pat. No. 5,934,376; U.S. Pat. No. 6,227,303; U.S. Pat. No. 6,298,916; U.S. Pat. No. 6,464,261; U.S. Pat. No. 6,516,882; U.S. Pat. No. 6,588,506; U.S. Pat. No. 6,749,023; U.S. Pat. No. 6,752,207; U.S. Pat. No. 6,789,624; U.S. Pat. No. 6,814,239; U.S. Pat. No. 6,817,410; International Application Publication No. WO 2004/094769; U.S. Patent Application Publication No. 2004/0003922; U.S. Patent Application Publication No. 2005/0284643; U.S. Patent Application Publication No. 2005/0205269; and "Alternate Path Completions: A Critical Review and Lessons Learned From Case Histories With Recommended Practices for Deepwater Applications," G. Hurst, et al. SPE Paper No. 86532-MS.

SUMMARY

In one embodiment, an apparatus associated with the production of hydrocarbons is described. The apparatus includes a tubular member having a central opening for fluid flow through the tubular member and at least one jumper tube external to the tubular member; an expansion element disposed around the tubular member and the at least one jumper tube, wherein the expansion element is configured to isolate at least a portion of an annulus between the tubular member and a wall of a wellbore.

In a second embodiment, another apparatus associated with the production of hydrocarbons is described. The apparatus includes a tubular member having a first opening for fluid flow through the interior of the tubular member; a sleeve disposed around the tubular member; a plurality of support members disposed between the tubular member and the sleeve, wherein a second opening is formed between the tubular member, sleeve, and the plurality of support members; and an expansion element disposed around the sleeve, wherein the expansion element is configured to substantially prevent fluid flow outside the sleeve.

In a third embodiment, a system associated with the production of hydrocarbons is described. The system includes a wellbore utilized to produce hydrocarbons from a subsurface reservoir; a production tubing string disposed within the wellbore; a plurality of sand control devices coupled to the production tubing string and disposed within an open-hole section of the wellbore; at least one packer coupled between two of the plurality of sand control devices, wherein the at least one packer is configured to substantially prevent fluid flow in at least a portion of an annulus between the tubular member and a wall of a wellbore; a first gravel pack disposed at least partially around at least one of the plurality of sand control devices upstream from the at least one packer; and a second gravel pack disposed at least partially around at least one of the plurality of sand control devices downstream from the at least one packer.

In a fourth embodiment, another system for producing hydrocarbons is described. The system includes a wellbore utilized to produce hydrocarbons from a subsurface reservoir; a production tubing string disposed within the wellbore; a plurality of sand control devices coupled to the production tubing string and disposed within the wellbore, wherein each of the plurality of sand control devices have a primary flow path isolated from the wellbore by a filter medium and a secondary flow path in fluid communication with the wellbore; at least one packer coupled to at least one of the plurality of sand control devices, the at least one packer having a primary flow path in communication with the primary flow path of the at least one of the plurality of sand control devices and a secondary flow path in communication with the secondary flow path of at least one of the plurality of sand control devices through a manifold region that commingles and redistributes flow within the secondary flow path of the at least one packer, wherein the at least one packer is configured to isolate flow between sections of the wellbore outside the primary flow path and the secondary flow path of the at least one packer.

In a fifth embodiment, a third system for producing hydrocarbons is described. This system includes a tubular barrier installed within a wellbore; a first packer coupled to the tubular barrier, wherein the first packer isolates a first annulus between a wall of the wellbore and the tubular barrier; at least two sand control devices disposed within the tubular barrier, wherein each of the at least two sand control devices have a primary flow path and a secondary flow path; a second packer coupled between the at least two sand control devices and configured to isolate a second annulus between the at least two sand control devices and the tubular barrier, the second packer having a primary flow path in communication with the primary flow path of the at least two sand control devices and a secondary flow path in communication with the secondary flow path of the at least two sand control devices; a first gravel pack formed between the tubular barrier and one of the at least two sand control devices; and a second gravel pack formed between the tubular barrier and another of the at least two sand control devices.

In a sixth embodiment, a method for producing hydrocarbons from a well is described. The method includes disposing sand control devices and at least one packer within a wellbore adjacent to a subsurface reservoir, wherein each of the sand control devices includes at least one shunt tube and each of the at least one packer includes a primary and secondary flow path, wherein the secondary flow path of the at least one packer is in fluid communication with the at least one shunt tube of the sand control devices; setting the at least one packer within the open-hole section; gravel packing the sand control devices in a first interval of the subsurface reservoir upstream of the at least one packer; gravel packing the sand control devices in a second interval of the subsurface reservoir downstream from the at least one packer by passing a carrier fluid having gravel through the secondary flow path of the at least one packer; and producing hydrocarbons from the wellbore by passing hydrocarbons through the sand control devices. In addition, the method may also include conditioning a drilling fluid utilized to access a subsurface formation via the wellbore, wherein the plurality of sand control devices and the at least one packer are disposed in the wellbore in the conditioned drilling fluid; displacing the conditioned drilling fluid adjacent to the sand control devices and the at least one packer with a carrier fluid prior to setting the packer; and gravel packing the intervals of the wellbore with the carrier fluid having gravel.

In a seventh embodiment, a method of producing hydrocarbons from a well is disclosed comprising disposing at least three sand control devices and at least two packers within a wellbore adjacent to a subsurface reservoir, wherein each of the at least three sand control devices includes a primary flow path and at least one shunt tube, wherein the at least one shunt tube forms a secondary flow path and each of the at least two packers includes a primary and secondary flow path, wherein the secondary flow path of the at least two packers are in fluid communication with the at least one shunt tube of the at least three sand control devices. The method further includes positioning at least one of the at least three sand control devices upstream of the at least two packers and at least one of the at least three sand control devices downstream from the at least two packers, and setting the at least two packers within an open-hole section of the wellbore. Further, the method involves gravel packing at least two of the at least three sand control devices through the shunt tubes of the at least three sand control devices and the secondary fluid flow path of at least one of the at least two packers, wherein at least one of the at least three sand control devices remains unpacked, wherein the unpacked sand control device is downstream from at least one packed sand control device and upstream of at least one packed sand control device, and producing hydrocarbons from the wellbore by passing hydrocarbons through the sand control devices.

In a seventh embodiment, another method for producing hydrocarbons from a well is described. This method includes providing a plurality of sand control devices having a primary flow path and a secondary flow path through the interior of the sand control devices, wherein the secondary flow path is comprised of shunt tubes; coupling a packer having a tubular member and an expansion element disposed around the tubular member between two of the plurality of sand control devices, wherein the expansion element is configured to isolate a portion of an annulus between the tubular member and a wall of a wellbore and provide a primary flow path for the plurality of sand control devices through the interior of the tubular member and a secondary flow path through the packer, wherein the secondary flow path is in fluid communication with the shunt tubes of the plurality of sand control devices; and disposing the plurality of sand control devices and packer within a wellbore.

In an eighth embodiment, a method of operating a well is described. This method includes providing two sand control devices disposed within a wellbore adjacent to a subsurface reservoir, the two sand control devices having an interior, a primary flow path, and a secondary flow path, wherein the primary flow path passes through the interior of the sand control device; coupling a packer having an interior, a primary flow path and a secondary flow path between the two sand control devices, wherein the primary flow path is through the interior of the packer and adapted and configured to be in fluid communication with the primary flow paths of the two sand control devices and the secondary flow path is configured to be in fluid communication with the secondary flow paths of the two sand control devices; setting the packer within the wellbore such that one of the two sand control devices is above the packer and forms a first interval between the sand control device and the wall of the wellbore and the other of the two sand control devices is below the packer and forms a second interval between the plurality of sand control devices and the wall of the wellbore; gravel packing the first interval, gravel packing the second interval, and injecting a fluid into at least one of the group consisting of the first interval and the second interval by passing the fluid through the secondary flow paths of the sand control devices and the secondary flow path of the packer.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention are described in connection with its preferred embodiments. However, to the extent that the following description is specific to a particular embodiment or a particular use of the present techniques, it is intended to be illustrative only and merely provides a concise description of the exemplary embodiments. Accordingly, the invention is not limited to the specific embodiments described below, but rather; the invention includes all alternatives, modifications, and equivalents falling within the true scope of the appended claims.

The present techniques include one or more packers that may be utilized in a completion, production, or injection system to enhance well operations (e.g., gravel pack, and/or enhance production of hydrocarbons from a well and/or enhance the injection of fluids or gases into the well). Under the present techniques, packers with alternative path mechanisms may be utilized to provide zonal isolation between gravel packs in a well. In addition, well apparatuses are described that provide fluid flow paths for alternative path technologies within a packer that may be utilized in an open or cased-hole completion. These packers may include individual jumper tubes or a common manifold or manifold region that provide fluid communication through the packer to shunt tubes of the sand control devices. As such, the present techniques may be used in well completions for flow control, hydrocarbon production and/or fluid injection.

Figure 1:
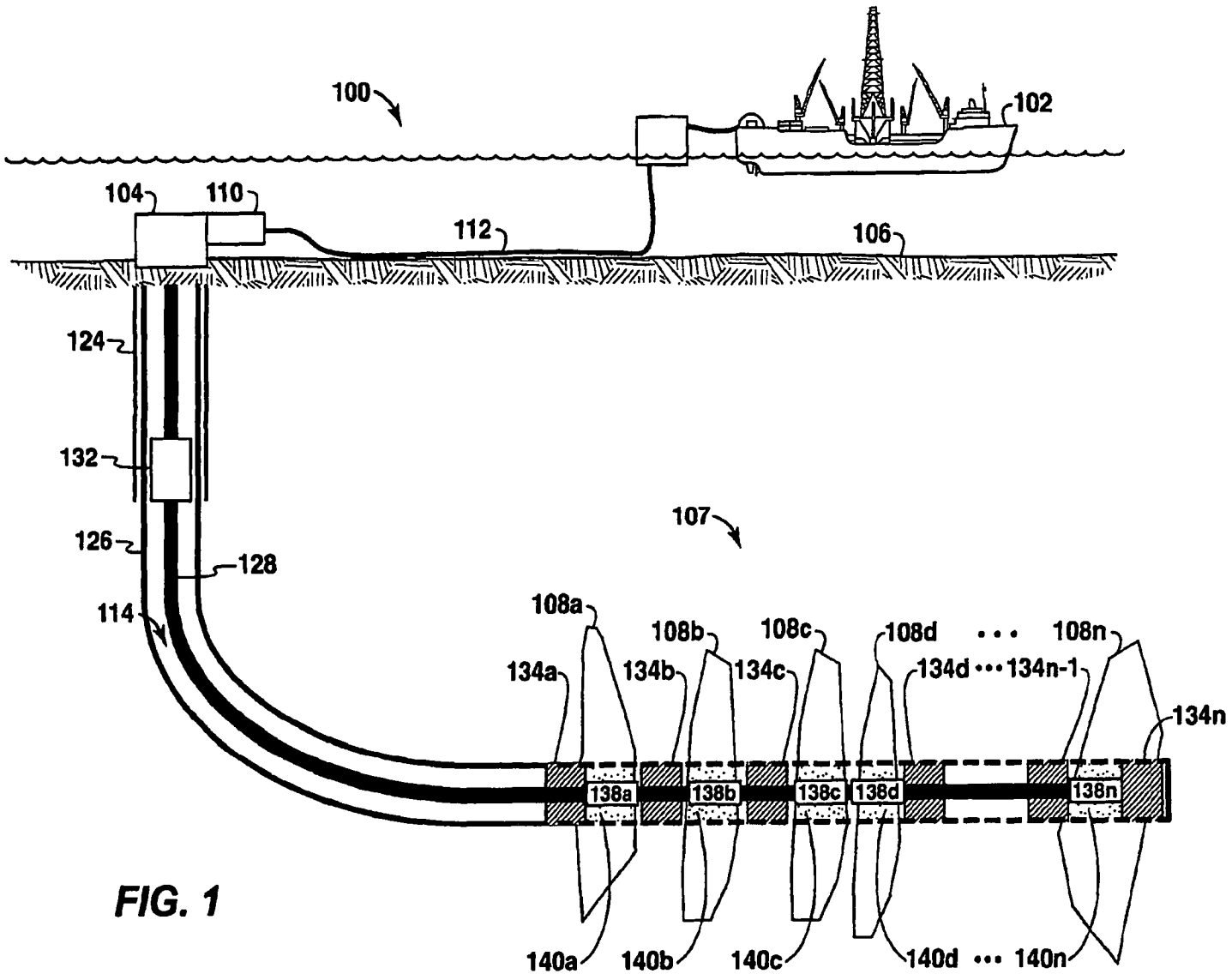
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108*n*, wherein number "n" is any integer number, having hydrocarbons, such as oil and gas. Beneficially, devices, such as sand control devices 138*a*-138*n*, may be utilized to enhance the production of hydrocarbons from the production intervals 108*a*-108*n*. However, it should be noted that the production system 100 is illustrated for exemplary purposes and the present techniques may be useful in the production or injection of fluids from any subsea, platform or land location.

The floating production facility 102 may be configured to monitor and produce hydrocarbons from the production intervals 108*a*-108*n* of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108*n*, the floating production facility 102 is coupled to a subsea tree 104 and control valve 110 via a control umbilical 112. The control umbilical 112 may include production tubing for providing hydrocarbons from the subsea tree 104 to the floating production facility 102, control tubing for hydraulic or electrical devices, and a control cable for communicating with other devices within the wellbore 114.

To access the production intervals 108*a*-108*n*, the wellbore 114 penetrates the sea floor 106 to a depth that interfaces with the production intervals 108*a*-108*n* at different depths within the wellbore 114. As may be appreciated, the production intervals 108*a*-108*n*, which may be referred to as production intervals 108, may include various layers or intervals of rock that may or may not include hydrocarbons and may be referred to as zones. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the wellbore 114, the production system 100 may also include different equipment to provide access to the production intervals 108*a*-108*n*. For instance, a surface casing string 124 may be installed from the sea floor 106 to a location at a specific depth beneath the sea floor 106. Within the surface casing string 124, an intermediate or production casing string 126, which may extend down to a depth near the production interval 108, may be utilized to provide support for walls of the wellbore 114. The surface and production casing strings 124 and 126 may be cemented into a fixed position within the wellbore 114 to further stabilize the wellbore 114. Within the surface and production casing strings 124 and 126, a production tubing string 128 may be utilized to provide a flow path through the wellbore 114 for hydrocarbons and other fluids. Along this flow path, a subsurface safety valve 132 may be utilized to block the flow of fluids from the production tubing string 128 in the event of rupture or break above the subsurface safety valve 132. Further, sand control devices 138*a*-138*n* may be utilized to manage the flow of particles into the production tubing string 128 with gravel packs 140*a*-140*n*. The sand control devices 138*a*-138*n* may include slotted liners, stand-alone screens (SAS); prepacked screens; wire-wrapped screens, membrane screens, expandable screens and/or wire-mesh screens, while the gravel packs 140*a*-140*n* may include gravel or other suitable solid material.

In addition to the above equipment, packers 134*a*-134*n* may be utilized to isolate specific zones within the wellbore annulus from each other. The packers 134*a*-134*n*, which may be herein referred to as packer(s) 134, may be configured to provide fluid communication paths between sand control devices 138*a*-138*n* in different intervals 108*a*-108*n*, while preventing fluid flow in one or more other areas, such as a wellbore annulus. The fluid communication paths may include a common manifold region or individual connections between shunt tubes through the packer. Regardless, the packers 134 may be utilized to provide zonal isolation and a mechanism for providing a substantially complete gravel pack within each interval 108*a*-108*n*. For exemplary purposes, the packers 134 are herein described further in various embodiments described below in FIGS. 3A-3D, 4A-4D and 5A-5C.

Figure 2A:
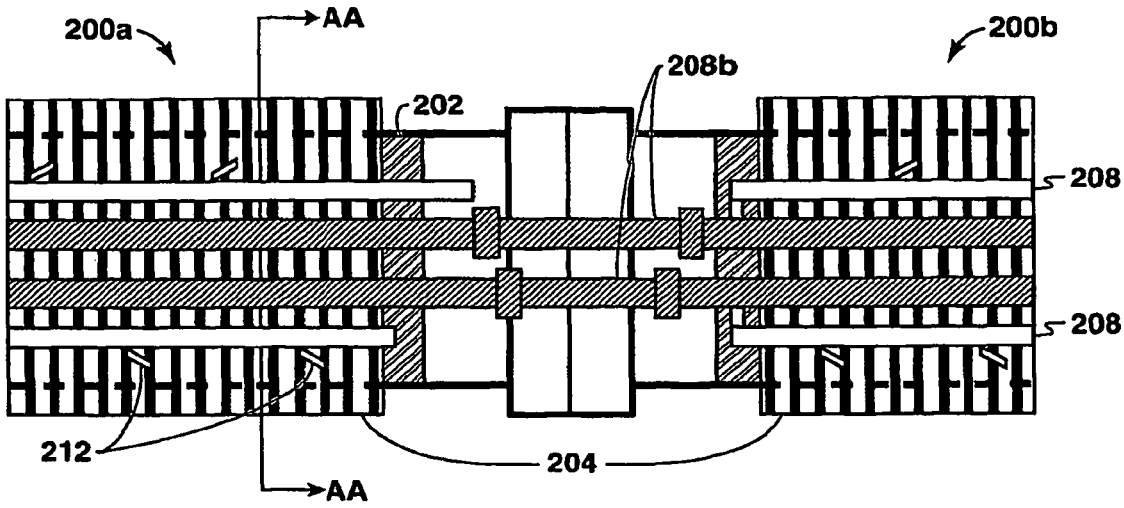
FIG. 2A Prior Art
FIGS. 2A-2B are example embodiments of conventional sand control devices utilized within wellbores.
Figure 2B:
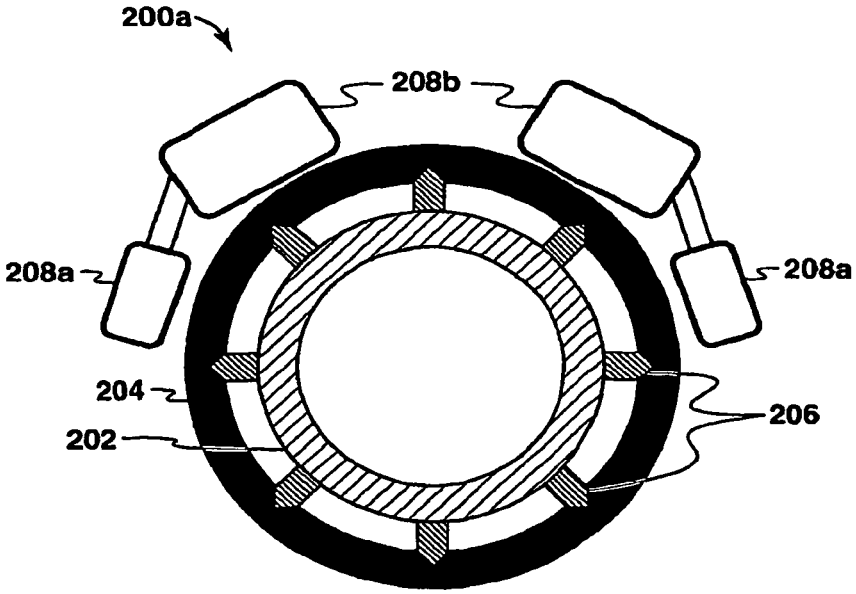
FIG. 2B Prior Art

FIGS. 2A-2B are partial views of embodiments of conventional sand control devices that are jointed together within a wellbore. Each of the sand control devices 200*a* and 200*b* may include a tubular member or base pipe 202 surrounded by a filter medium or sand screen 204. Ribs 206 may be utilized to keep the sand screens 204, which may include multiple wire segments, a specific distance from the base pipes 202. Shunt tubes 208*a* and 208*b*, which may be collectively referred to as shunt tubes 208, may include packing tubes 208*a* or transport tubes 208*b* and may also be utilized with the sand screens 204 for gravel packing within the wellbore. The packing tubes 208*a* may have one or more valves or nozzles 212 that provide a flow path for the gravel pack slurry, which includes a carrier fluid and gravel, to the annulus formed between the sand screen 204 and the walls of the wellbore. The valves may prevent fluids from an isolated interval from flowing through the at least one jumper tube to another interval. For an alternative perspective of the partial view of the sand control device 200*a*, a cross sectional view of the various components along the line AA is shown in FIG. 2B. It should be noted that in addition to the external shunt tubes shown in FIGS. 2A and 2B, which are described in U.S. Pat. Nos. 4,945,991 and 5,113,935, internal shunt tubes, which are described in U.S. Pat. Nos. 5,515,915 and 6,227,303, may also be utilized.

While this type of sand control device is useful for certain wells, it is unable to isolate different intervals within the wellbore. As noted above, the problems with the water/gas production may include productivity loss, equipment damage, and/or increased treating, handling and disposal costs. These problems are further compounded for wells that have a number of different completion intervals and where the formation strength may vary from interval to interval. As such, water or gas breakthrough in any one of the intervals may threaten the remaining reserves within the well. Accordingly, to provide the zonal isolation within the wellbore 114, various embodiments of packers that provide alternative flow paths are discussed below in FIGS. 3A-3D, 4A-4D and 5A-5C.

FIGS. 3A-3D are exemplary embodiments of a packer having individual jumper tubes, which may be utilized in the production system 100 of FIG. 1 in accordance with certain aspects of the present techniques. Accordingly, FIGS. 3A-3D may be best understood by concurrently viewing FIGS. 1 and 2A-2B. In the embodiments, a packer 300, which may be one of the packers 134*a*-134*n*, is utilized with individual jumper or shunt tubes 318 to provide carrier fluid along with gravel to different isolated intervals 108*a*-108*n* within the wellbore 114.

Figure 3A:
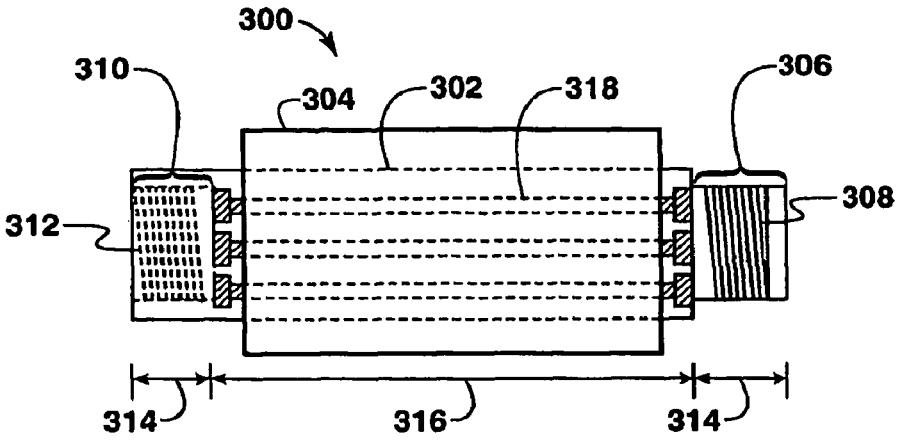
FIGS. 3A-3D are exemplary embodiments of a packer utilized with individual shunt tubes utilized in the production system of FIG. 1 in accordance with certain aspects of the present techniques.

In FIG. 3A, a packer 300 includes various components that are utilized to isolate an interval; which may be an interval 108*a*-108*n*, within a well 114. For instance, the packer 300 includes a main body section 302, an expansion element 304, a neck section 306, notched section 310 and transport or jumper tubes 318. The main body section 302 may be made of steel or steel alloys with the main body section 302 configured to be a specific length 316, such as about 14, 38 or 40 feet (ft) (common joints are between about 10 ft and 50 ft) having specific internal and outer diameters. The expansion element 304 may be this length 316 or less. The jumper tubes 318 may be blank sections of pipe having a length 316 (some embodiments may have a length substantially equal to the length of the expansion element 304), and configured to couple to and form a seal with shunt tubes 208 on sand control devices 200*a* and 200*b*. The jumper tubes 318 may also include a valve 320 within the jumper tube 318 to prevent fluids from an isolated interval from flowing through the jumper tube 318 to another interval. The packer element or expansion element 304 may surround the main body section 302 and jumper tubes 318 and may be a hydraulically actuated inflatable element (an elastomer or thermoplastic material) or a swelling rubber element in contact with the jumper tube 318. The swelling rubber element may expand in the presence of hydrocarbons, water or other stimulus.

As an example, a swelling rubber element may be placed in the well and allowed to expand to contact the walls of the wellbore prior to or during hydrocarbon production. It is also possible to use a swellable packer that expands after water begins to enter the wellbore and contacts the packer. Examples of swellable materials that may be used may be found in Easy Well Solutions' CONSTRICTOR™ or SWELLPACKER™, and SwellFix's E-ZIP™. The swellable packer may include a swellable polymer or swellable polymer material, which is known by those skilled in the art and which may be set by one of a conditioned drilling fluid, a completion fluid, a production fluid, an injection fluid, a stimulation fluid, or any combination thereof.

In addition, the packer 300 may include a neck section 306 and notched section 310. The neck section 306 and notched section 310 may be made of steel or steel alloys with each section configured to be a specific length 314, such as 4 inches (in) to 4 feet (ft) (or other suitable distance), having specific internal and outer diameters. The neck section 306 may have external threads 308 and the notched section 310 may have internal threads 312. These threads 308 and 312 may be utilized to form a seal between the packer 300 and a sand control device or another pipe segment, which is shown below in FIGS. 3B-3D.

Figure 3B:
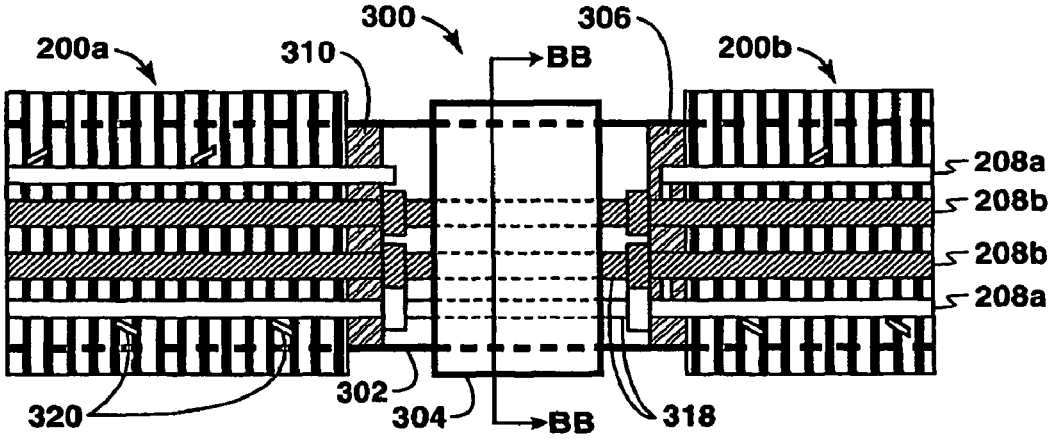
Figure 3C:
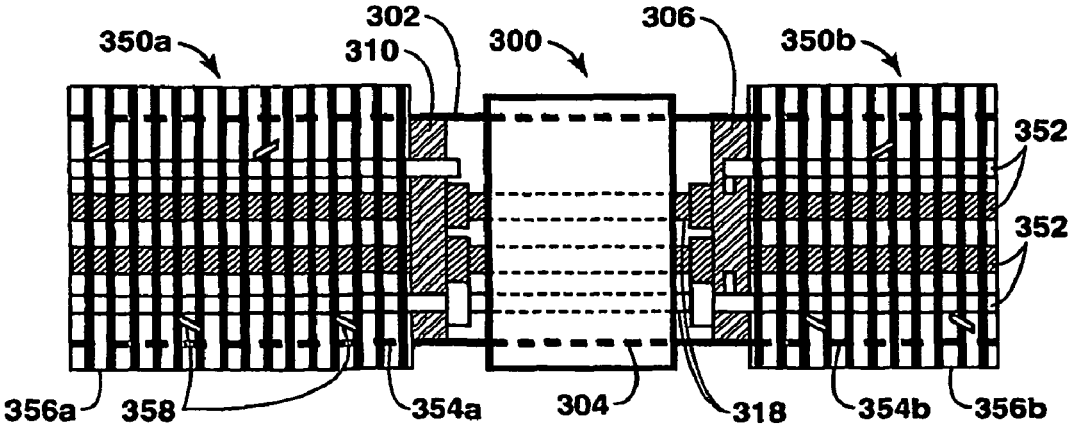
Figure 3D:
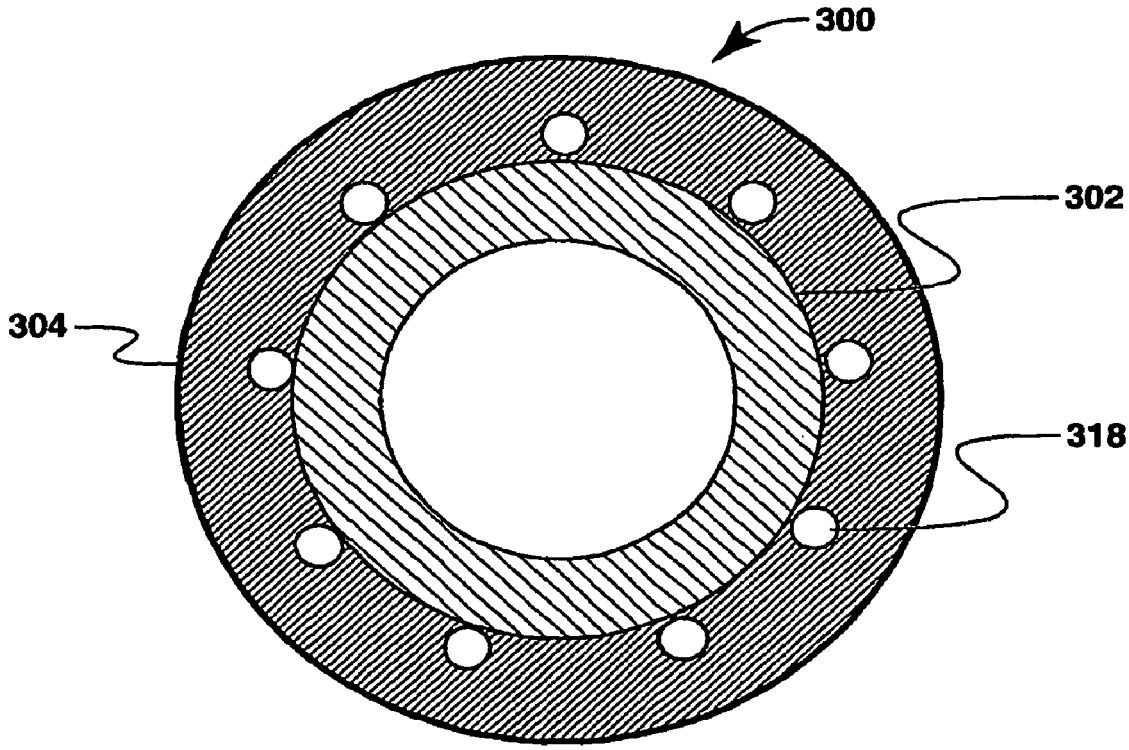

The configuration of the packer 300 may be modified for external shunt tubes, as shown in FIG. 3B, and for internal shunt tubes as shown in FIG. 3C. In FIG. 3C, the sand control devices 350*a* and 350*b* may include internal shunt tubes 352 disposed between base pipes 354*a* and 354*b* and filter mediums or sand screens 356*a* and 356*b*, which are similar to the sand control devices 200*a* and 200*b*. In FIGS. 3B and 3C, the neck section 306 and notched section 310 of the packer 300 is coupled with respective sections of the sand control devices 200*a*, 200*b*, 350*a* and 350*b*. These sections may be coupled together by engaging the threads 308 and 312 to form a threaded connection. Further, the jumper tubes 318 may be coupled individually to the shunt tubes 208. Because the jumper tubes 318 are configured to pass through the expansion element 304, the jumper tubes 318 form a continuous flow path through the packer 300 for the shunt tubes 208. An alternative perspective of the partial view of the packer 300, a cross sectional view of the packer 300 along the line BB is shown in FIG. 3D.

FIGS. 4A-4D are exemplary embodiments of a packer utilized with a manifold, which may also be utilized in the production system 100 of FIG. 1 in accordance with certain aspects of the present techniques. Accordingly, FIGS. 4A-4D may be best understood by concurrently viewing FIGS. 1 and 2. In the embodiments, a packer 400, which may be one of the packers 134*a*-134*n*, is utilized with a manifold or opening 420 to provide a fluid flow or communication path between multiple shunt tubes on sand control devices. The manifold 420, which may also be referred to as a manifold region or manifold connection, may be utilized to couple to external or internal shunt tubes of different geometries without the concerns of alignment that may be present in other configurations.

Figure 4A:
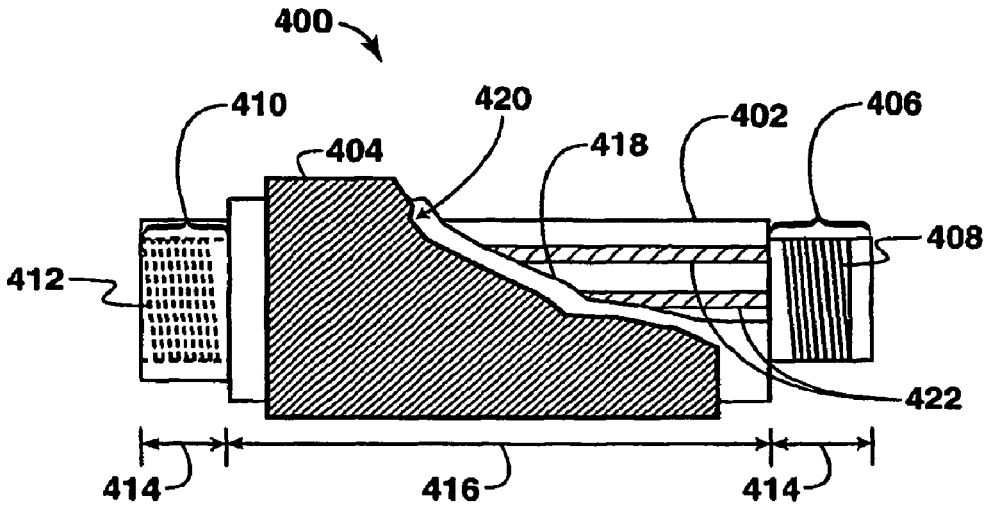
FIGS. 4A-4D are exemplary embodiments of packers and configurations utilized in the production system of FIG. 1 in accordance with certain aspects of the present techniques.

In FIG. 4A, a packer 400, which may be one of the packers 134*a*-134*n*, includes various components that are utilized to isolate an interval within a well. For instance, the packer 400 includes a main body section 402, a packer element or an expansion element 404, a neck section 406, notched section 410, support members or segments 422 and a sleeve section 418 that creates the opening or manifold 420. The main body section 402 and sleeve section 418 may be made of steel or steel alloys and configured to be a specific length 416, such as between 6 inches to 50 ft, more preferably 14, 38, or 40 ft as discussed above, having specific internal and outer diameters. The sleeve section 418 may also be configured to couple to and form a seal with shunt tubes, such as shunt tubes 208 on sand control devices 200*a* and 200*b*. The support segments 422 are utilized to form the opening 420 and placed between the main body section 402 and the sleeve section 418 to support the expansion element 404 and the sleeve section 418. The expansion element 404 may be similar to the expansion element 304. For instance, the expansion element may be inflated, swelled, or possibly squeezed against the walls of the wellbore or casing string. That is, the expansion element 404 may include an inflatable element, cup-type packer, an element actuated hydraulically, hydrostatically, or mechanically, an element set by radio frequency identification, and swellable material, for example. The swellable material or a swellable polymeric material that expands in the presence of at least one of oil, water, and any combination thereof. Also, the expansion element 404 may be set by drilling fluid, production fluid, completion fluid, injection fluid, stimulation fluid, and any combination thereof.

In addition, the packer 400 may include a neck section 406 and notched section 410. The neck section 406 and notched section 410 may be made of steel or steel alloys with each section configured to be a specific length 414, which may be similar to the length 314 discussed above, and having specific internal and outer diameters. The neck section 406 may have external threads 408 and the notched section 410 may have internal threads 412. These threads 408 and 412 may be utilized to form a seal between the packer 400 and a sand control device or another pipe segment, which is shown below in FIGS. 4B-4D. It should also be noted that the coupling mechanism for these packers and sand control devices may include sealing mechanisms as described in U.S. Pat. No. 6,464,261; Intl. Patent Application No. WO2004/094769; Intl. Patent Application No. WO2005/031105; U.S. Patent Application Pub. No. 2004/0140089; U.S. Patent Application Pub. No. 2005/0028977; U.S. Patent Application Pub. No. 2005/0061501; and U.S. Patent Application Pub. No. 2005/0082060.

Figure 4B:
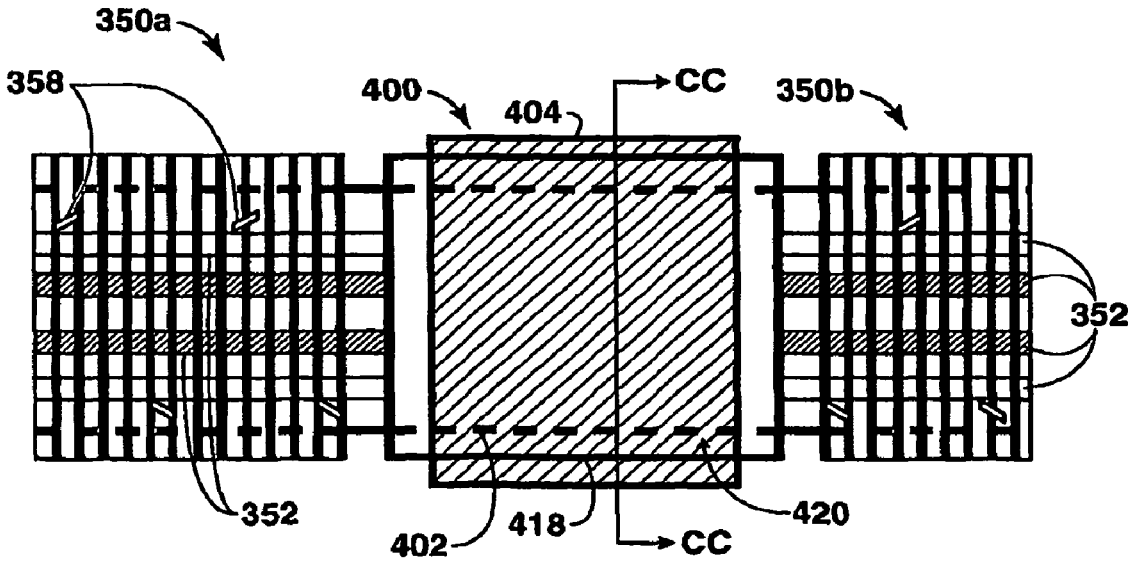
Figure 4C:
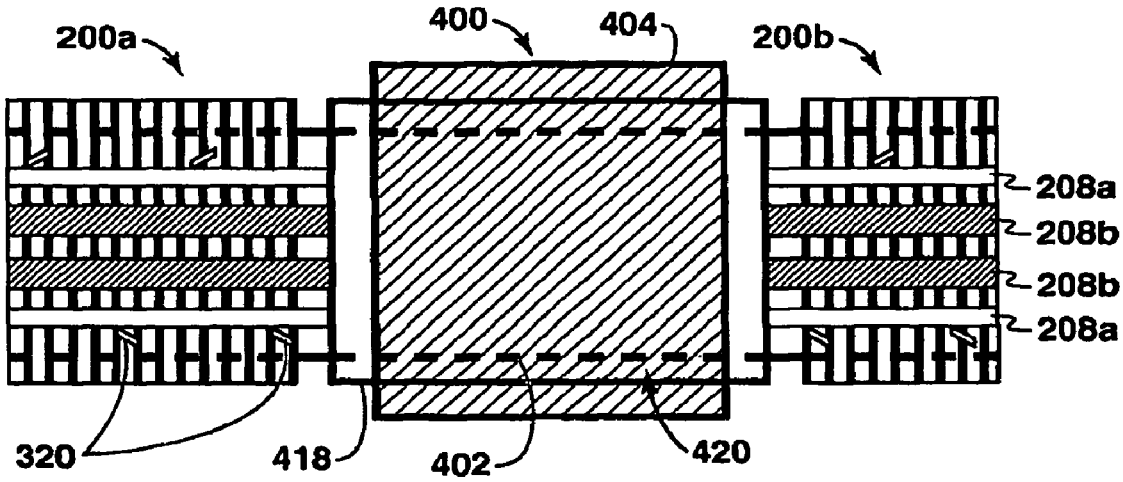
Figure 4D:
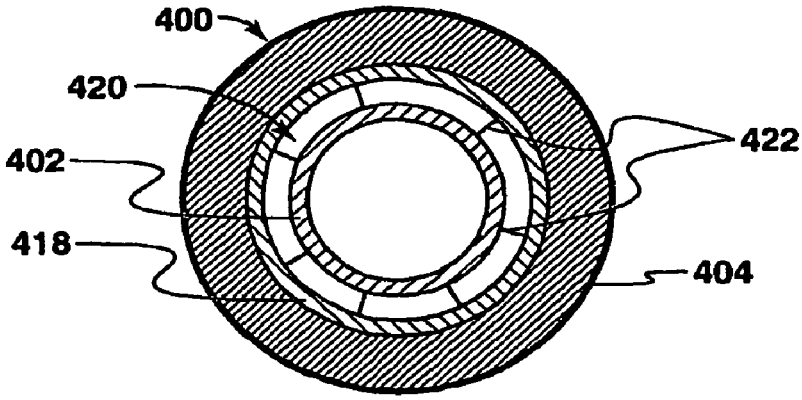

The configuration of the packer 400 is shown in FIG. 4B for internal shunt tubes and in FIG. 4C for external shunt tubes. In FIGS. 4B and 4C, the neck section 406 and notched section 410 of the packer 400 are coupled with respective sections of the sand control devices 200*a*, 200*b*, 350*a* and 350*b*. These sections may be coupled together by engaging the threads 408 and 412 to form a threaded connection or through the seal mechanism described in the references above. Regardless, the opening 420 provides unrestricted fluid flow paths between the shunt tubes 208 and 352 in the sand control devices 200*a*, 200*b*, 350*a* and 350*b* coupled to packer 400. The opening 420 is configured to pass through the expansion element 404, and is a substantially unrestricted space. Alignment in this configuration is not necessary as fluids are commingled, which may include various shapes. The sand control device is connected to the packer with a manifold connection. Flow from the shunt tubes in the sand control device enters a sealed area above the connection where flow is diverted into the packer flow paths or opening 420. An alternative perspective of the partial view of the packer 400, a cross sectional view of the various components along the line CC is shown in FIG. 4D.

Figure 5A:
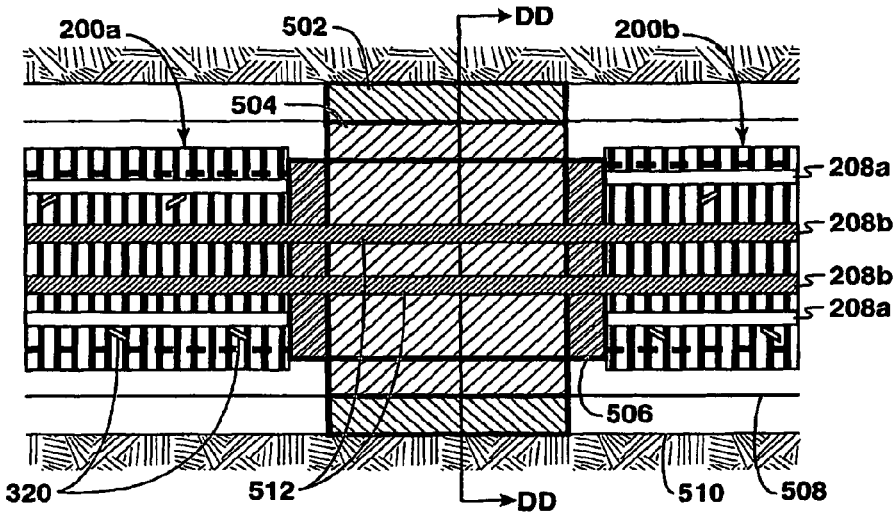
FIGS. 5A-5C are exemplary embodiments of a two or more packers utilized in the production system of FIG. 1 in accordance with certain aspects of the present techniques.
Figure 5B:
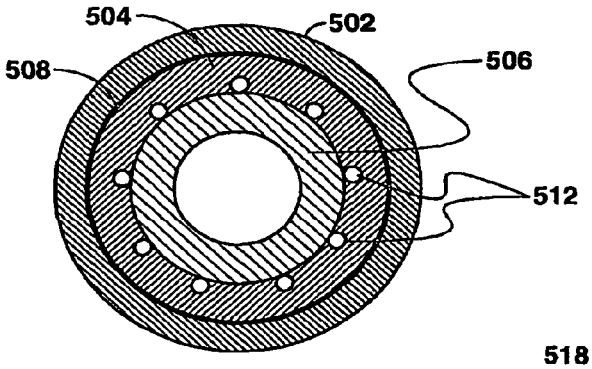
Figure 5C:
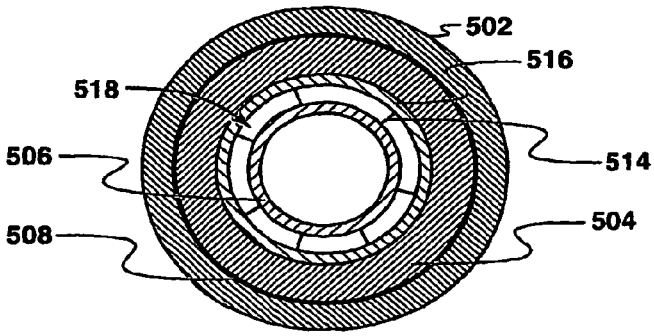

FIGS. 5A-5C are exemplary embodiments of two or more packers utilized in the production system 100 of FIG. 1 in accordance with certain aspects of the present techniques. Accordingly, FIGS. 5A-5C may be best understood by concurrently viewing FIGS. 1, 2, 3A-3D and 4A-4D. In the embodiments, two packers 502 and 504, which may be a cased-hole packer and an open-hole packer that are represented as one of the packers 134*a*-134*n*, are utilized along with a liner 508 within the wellbore to isolate different intervals 108*a*-108*n*.

In FIG. 5A, a first packer 502 and a second packer 504 may be utilized with a tubular barrier, such as a liner 508 to isolate an interval within a well. The first packer 502 may be disposed around the liner 508 and may include, for example, one of the packer 300, the packer 400, an E-ZIP™, CONSTRICTOR™, or any suitable open-hole packer known to persons of skill in the art. Depending upon the particular embodiment, the second packer 504 may be disposed between a base pipe 506 and the liner 508 and may include, for example, one of the packer 300, the packer 400, an MZ PACKER™, or any suitable cased-hole packer known to persons of skill in the art. The type of packer used may depend on the location of the packer (e.g. between producing intervals 108*a* and 108*b* or upstream of interval 108*a*) and the provision of alternative flow paths. That is, one of the packers 300 or 400 may be utilized with a conventional packer for other specific embodiments. The liner 508 may be a predrilled liner, which may include openings, perforations and designed slots, that is utilized to provide stability to the wall 510 of the wellbore. The first packer 502 isolates the annulus formed between the wall 510 of the wellbore and liner 508, while the second packer 504 isolates the annulus formed between the liner 508 and the sand screens 200*a* and 200*b*. Accordingly, the use of the packers 602 and 504 with a liner 508 may provide zonal isolation within the well.

As an alternative perspective of the packers 502 and 504, a cross sectional view of the packers 502 and 504 along the line DD is shown in FIGS. 5B and 5C. In FIG. 5B, the first packer 502 may be a conventional open-hole packer such as, for example, the CONSTRICTOR™, that forms a seal between the wall of the wellbore and the liner and the second packer 504 may be the packer 300. Accordingly, in this embodiment, the jumper tubes 512 may be utilized to couple the shunt tubes 208 of the sand control devices 200*a*-200*b*. Alternatively, in FIG. 5C, the first packer 502 may again be an external packer, while the second packer 504 may be the packer 400. Accordingly, in this embodiment, the sleeve section 516 and support segments 614 may be utilized to form an opening 518 that provides a fluid flow path for the shunt tubes 208 of the sand control devices 200*a*-200*b*. The installation and use of these packers is discussed further below.

Figure 6:
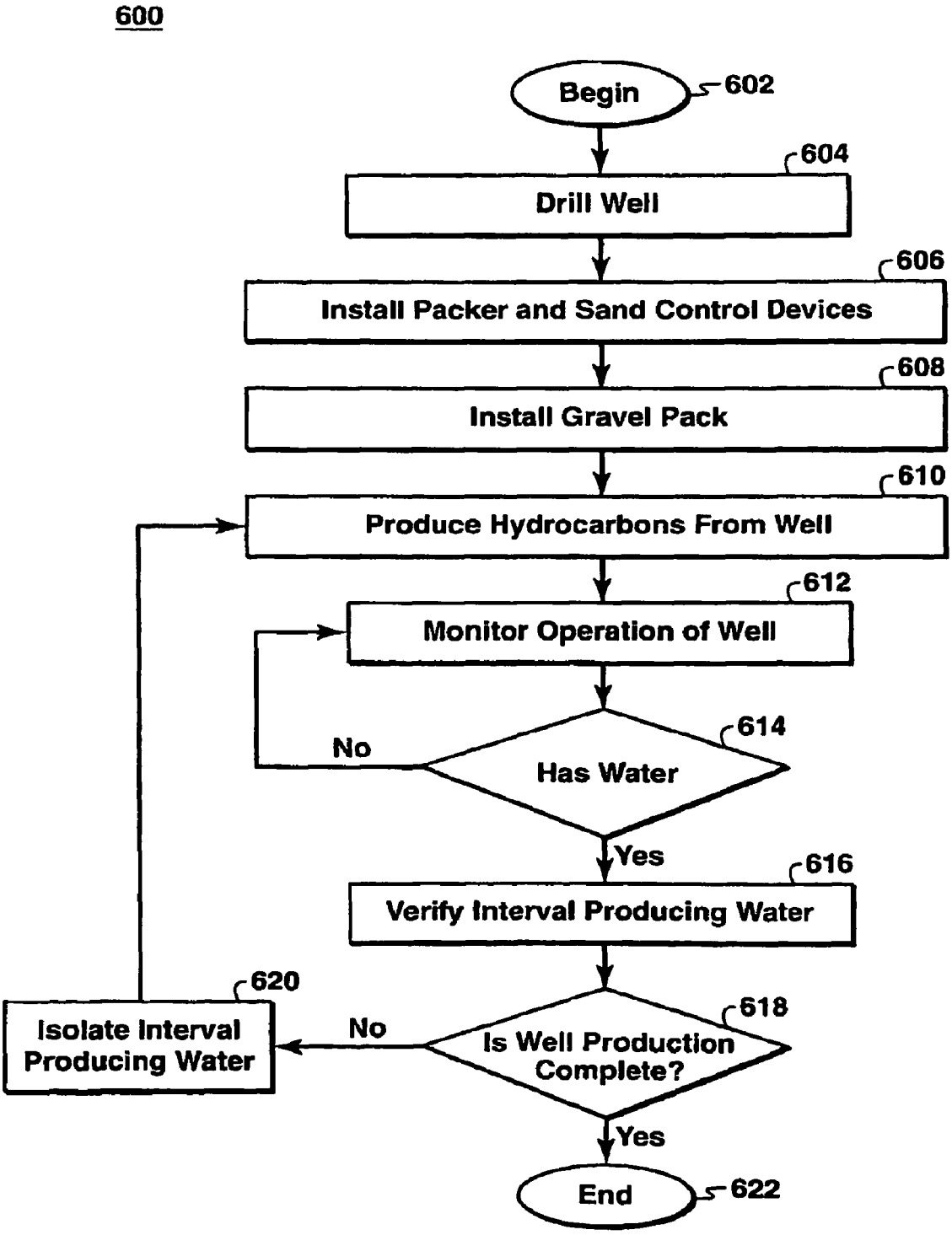
FIG. 6 is an exemplary flow chart of the use of a packer along with the sand control devices of FIG. 1 in accordance with aspects of the present techniques.

FIG. 6 is an exemplary flow chart of the use of the packer or packers along with the sand control devices of FIG. 1 in accordance with aspects of the present techniques. This flow chart, which is referred to by reference numeral 600, may be best understood by concurrently viewing FIGS. 1, 3A-3D, 4A-4D and 5A-5C. In this flow chart 600, a process to enhance the production of hydrocarbons from a wellbore 114 by providing zonal isolation in a gravel pack is described. That is, the present techniques provide zonal isolation in a wellbore that includes gravel packs. Accordingly, the packers utilized with the gravel pack provide zonal isolation, which may enhance the production of hydrocarbons from production intervals 108 of the subsurface formation 107.

The flow chart begins at block 602. At block 604, a well may be drilled. The well may be drilled to a specific depth location through various production intervals 108 of the subsurface formation 107. The drilling of the well may involve typical techniques utilized for different fields. Then, one or more packers and sand control devices may be installed into the well, as shown in block 606. The packers and sand control devices, which may include the packer embodiments of FIGS. 3A-3D, 4A-4D and 5A-5C, may be installed using various techniques. For the embodiments of FIGS. 5A-5C, this installation may also include installing a predrilled liner. At block 608, a gravel pack may be installed within the wellbore. The installation of the packers, sand control devices, and gravel pack are discussed further below in FIGS. 7 and 8A-8N.

With the packers, sand control devices and gravel pack installed, the well may be operated, as discussed in blocks 610-614. At block 610, hydrocarbons, such as oil and gas, may be produced from the well. During production, the operation of the well may be monitored, as shown in block 612. The monitoring of the well may include general surveillance, such as monitoring the water cut from the well or other similar techniques. Also, the monitoring may include sensors that determine the levels of gas present within the wellbore. At block 614, a determination about an increase in the production of water is made. This determination may include comparing the water cut to a predetermined threshold, or indication from a monitor within the wellbore that the amount of water being produced is increasing or has exceeded a specific threshold. If the water production has not increased, the well monitoring of the well may continue in block 612.

However, if the water production has increased, the interval producing water may be verified, as shown in block 616. The verification of the interval producing water may include obtaining information from one or more sensors associated with the interval or running a production logging tool (PLT) via wireline to a specific location within the well to confirm the interval producing water, for example. Then, a determination is made whether the well production is complete, as shown in block 618. If the well production is not complete, then the interval producing water is isolated, as shown in block 620. The isolation of the water producing interval may include different techniques based on the location of the water producing interval. For instance, if the water producing interval is located at the toe of the wellbore (i.e. end of a deviated portion of the wellbore), such as interval 108*n*, a plug may be run into the wellbore 114 and set via an electric line at a location before the sand control device 138*n*. This plug and packer 134*n*-1 isolates the production interval 138*n* from producing water into the production tubing 128. Alternatively, if the water producing interval is located at the heel of the wellbore (i.e. beginning of a deviated portion of the wellbore), such as interval 108*a*, a straddle assembly may be run into the wellbore 114 and installed across the water producing interval. This straddle assembly and packers 134*a* and 138*b* isolate the production interval 138*a* from producing water into the production tubing 128. Regardless, if the well production is complete, then the process may end at block 622.

Beneficially, the use of the packers along with the sand control devices in a gravel pack provides flexibility in isolating various intervals from unwanted gas or water production, while still being able to protect against sand production. Isolation also allows for the use of inflow control devices (e.g. Reslink's RESFLOW™ and Baker's EQUALIZER™) to provide pressure control for individual intervals. It also provides flexibility to install flow control devices (e.g. chokes) that may regulate flow between formations of varying productivity or permeability. Further, an individual interval may be gravel packed or may not need to be gravel packed. That is, the gravel packing operations may be utilized to gravel pack selective intervals, while other intervals are not gravel packed as part of the same process. Finally, individual intervals may be gravel packed with different size gravel from the other zones to improve well productivity. Thus, the size of the gravel may be selected for specific intervals.

Figure 7:
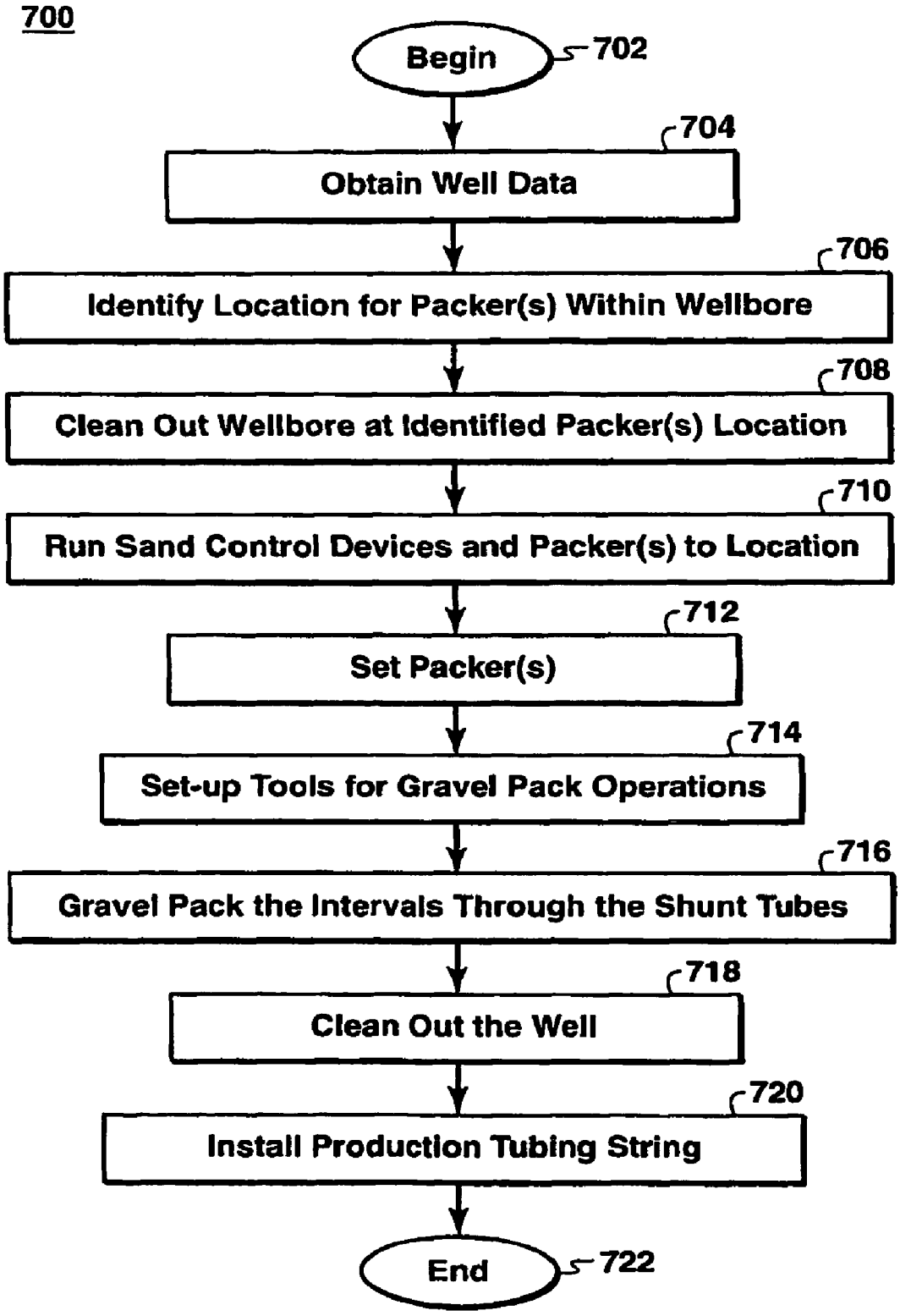
FIG. 7 is an exemplary flow chart of the installation of the packer, sand control devices, and gravel pack of FIG. 6 in accordance with aspects of the present techniques.

FIG. 7 is an exemplary flow chart of the installation of the packer, sand control devices, and gravel pack of FIG. 6 in accordance with aspects of the present techniques. This flow chart, which is referred to by reference numeral 700, may be best understood by concurrently viewing FIGS. 1, 3A-3D, 4A-4D, 5A-5C and 6. In this flow chart 700, a process for installing the sand control devices, packer and gravel pack into a wellbore, such as wellbore 114, is described.

The flow chart begins at block 702. At block 704, well data may be obtained. The well data may be obtained by capturing the open-hole logs and providing these open-hole logs to an engineer. At block 706, a location for the packer may be identified. To identify a location, the engineer may review and identify sections of the wellbore to select a packer location. Then, the wellbore may be cleaned out at the identified location, as shown in block 708. The clean out may be performed by a clean out assembly, which may include hole openers, brushes and scrapers, for example.

The packers and sand control devices may be run to the location, as shown in block 710. Again, the packers may include the various embodiments discussed above. Also, for the embodiments of FIGS. 5A-5C, a predrilled liner and an open-hole packer may be installed prior to the installation of the packers with the sand control devices. Once at the target location, the packers are set, as shown in block 712. The setting of the packers may include introducing a stimulus to the packers, such as hydrocarbons, to force the packers to expand and isolate the specific portions of the wellbore.

Then, the gravel pack operations may begin, as shown in block 714-720. At block 714, tools may be set up for the gravel pack operations. The tools may include a crossover tool and other equipment that is utilized to provide a carrier fluid having gravel to the intervals within the wellbore. The carrier fluid may be a fluid viscosified with HEC polymer, a fluid viscosified with xanthan polymer, or a fluid viscosified with visco-elastic surfactant. Also, the carrier fluid may be selected to have a favorable rheology and sand carrying capacity for gravel packing the intervals of the wellbore using sand control devices with alternate path technology. Then, at block 716, the intervals are gravel packed. The lower intervals (e.g. toe intervals or intervals identified for selective gravel packing) may be gravel packed by utilizing shunt tubes. Also, the order of the gravel packing may be performed from the heel to the toe of the wellbore or any specific sequence based upon the shunt tubes or other equipment that is utilized. Once the gravel packs 140*a*-140*n* are formed, the wellbore fluids may be cleared out and replaced with a completion fluid, as shown in block 718. At block 720, the production tubing 128 may be installed and the well brought into operation. The process ends at block 722.

Figure 8A:
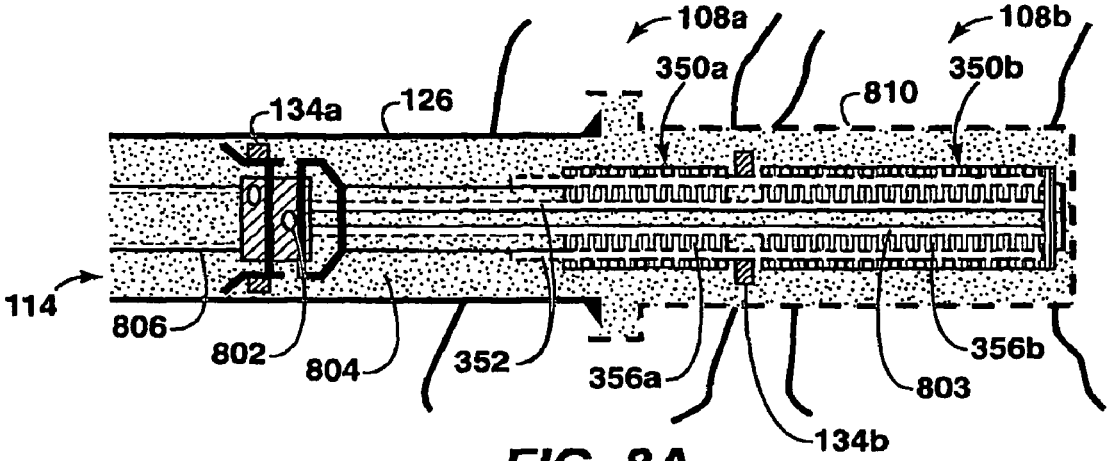
FIGS. 8A-8N are exemplary embodiments of the installation process for the packer, sand control devices, and gravel pack of FIG. 7 in accordance with certain aspects of the present techniques.
Figure 8B:
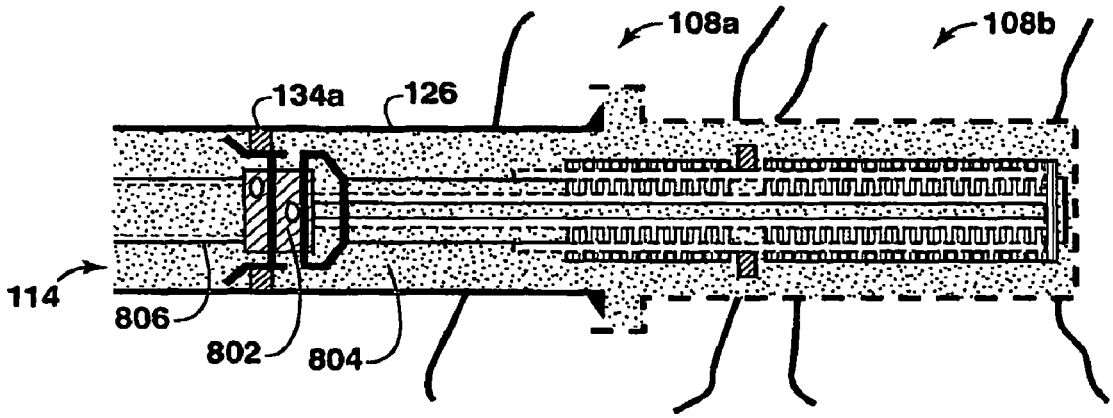
Figure 8C:
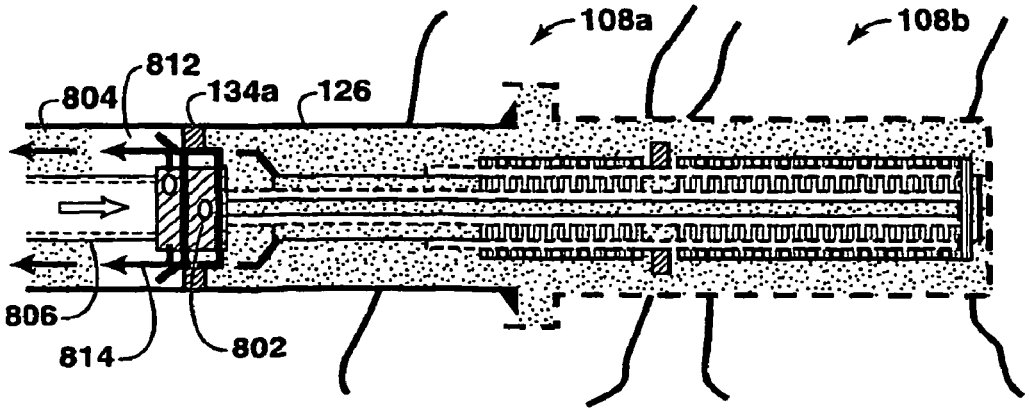
Figure 8D:
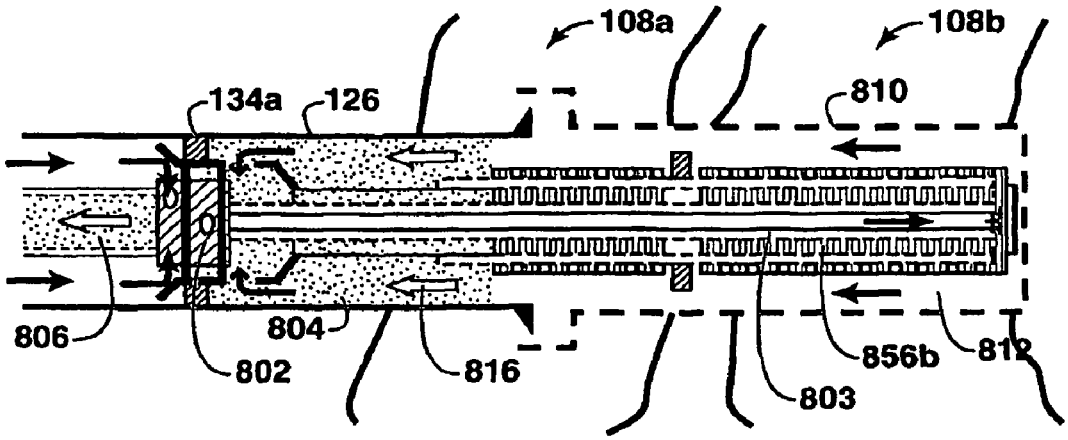
Figure 8E:
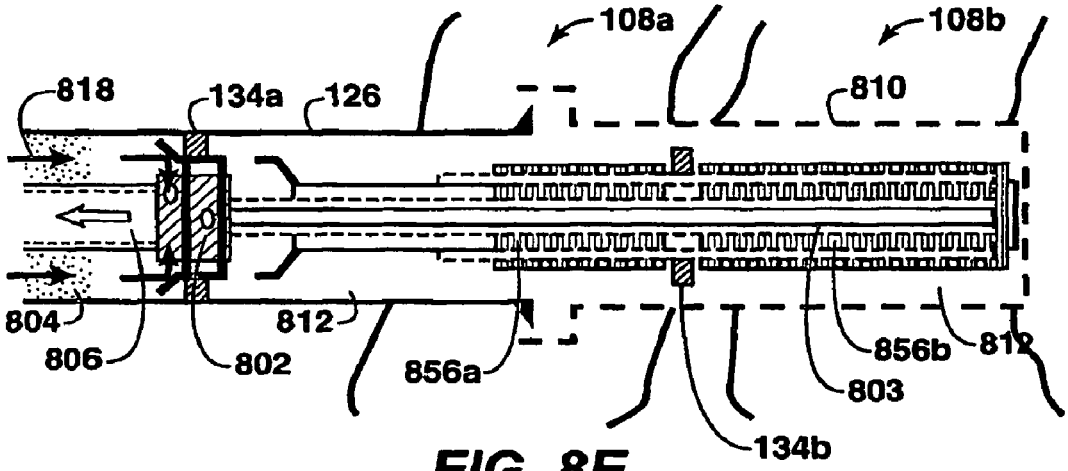
Figure 8F:
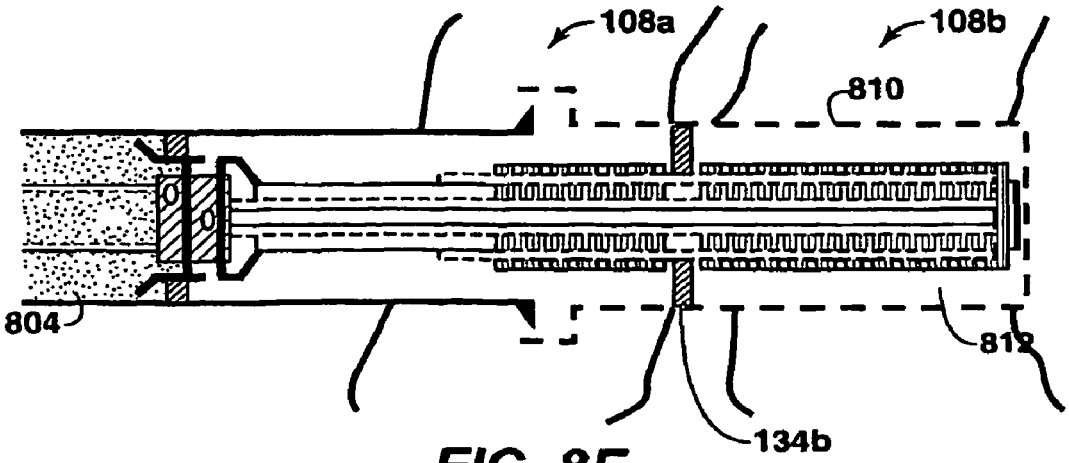
Figure 8G:
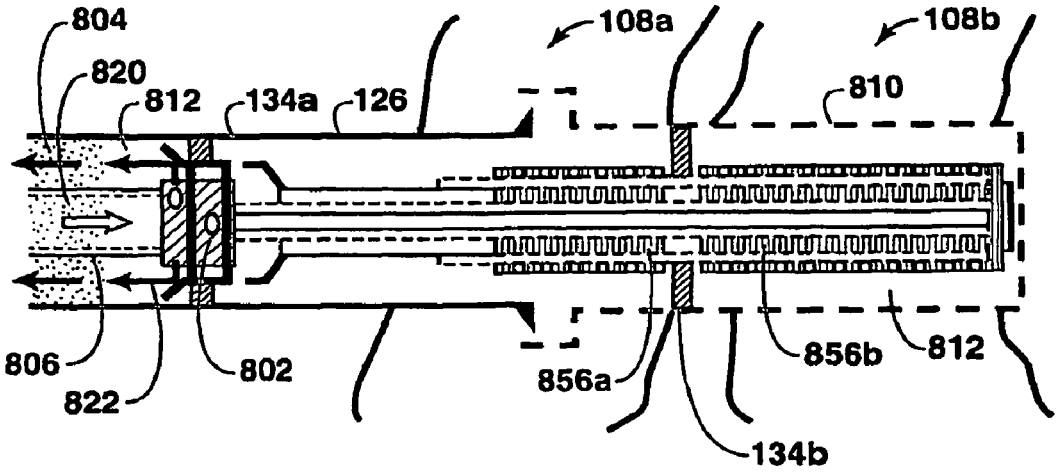
Figure 8H:
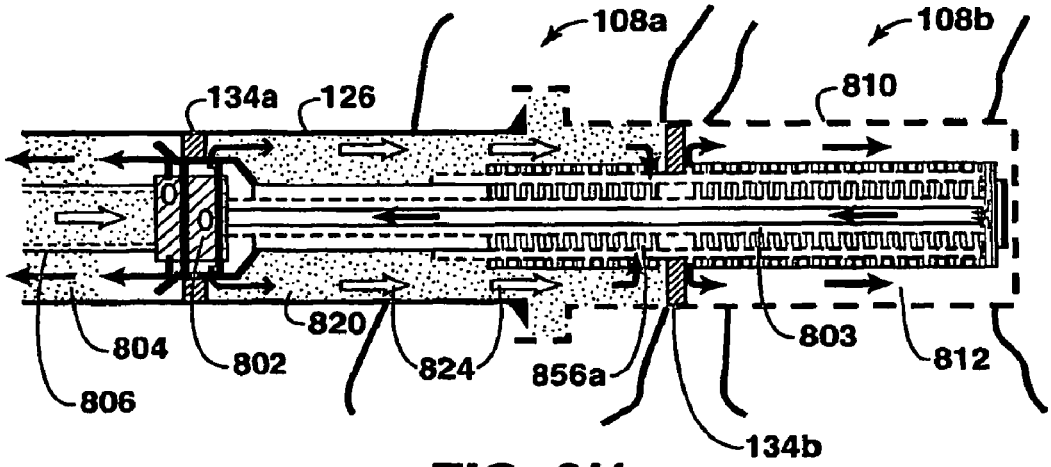
Figure 8I:
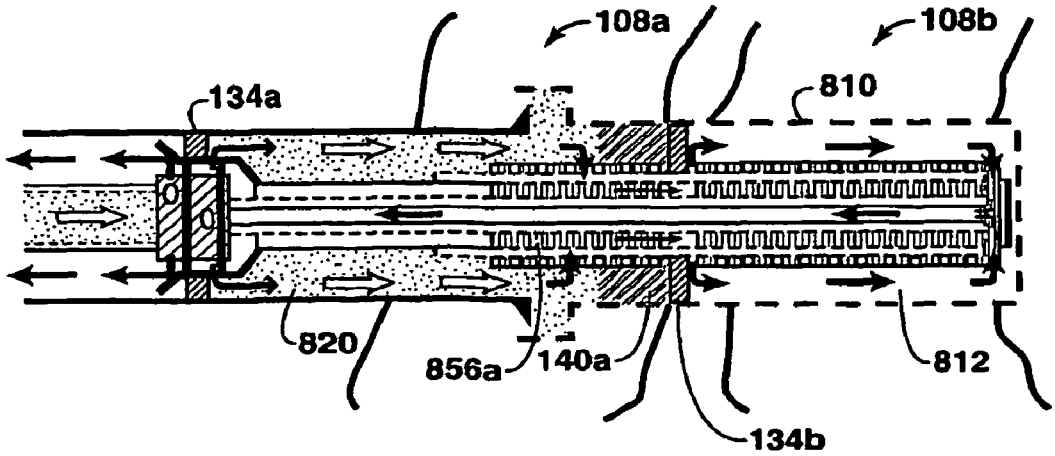
Figure 8J:
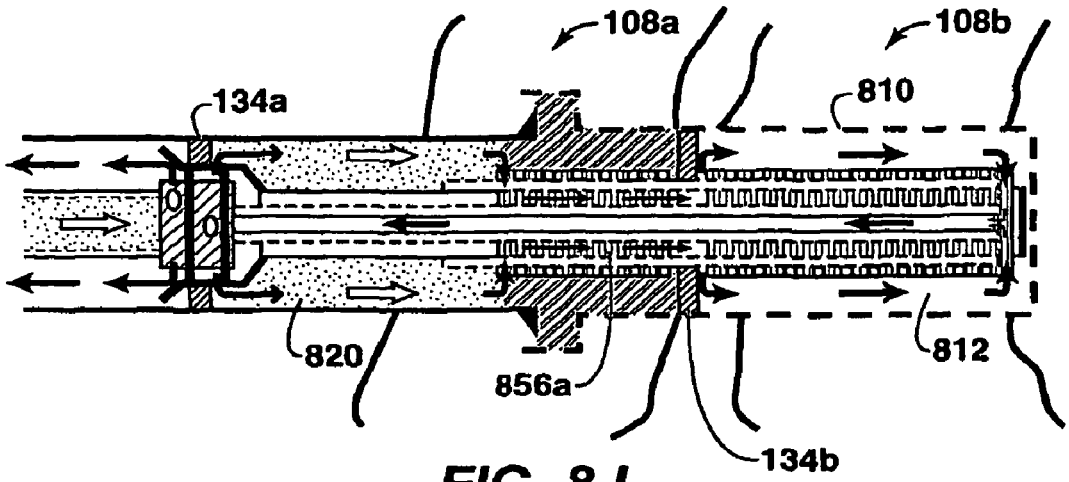
Figure 8K:
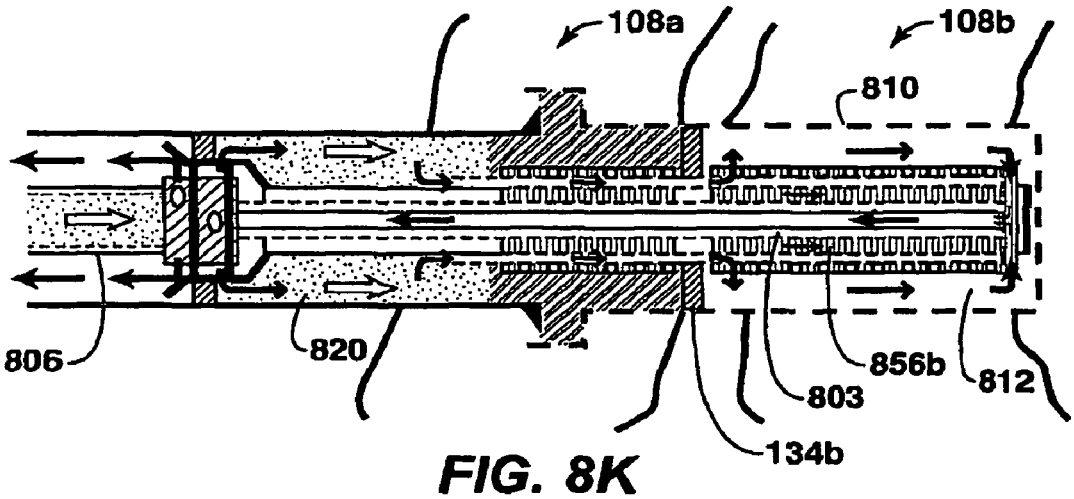
Figure 8L:
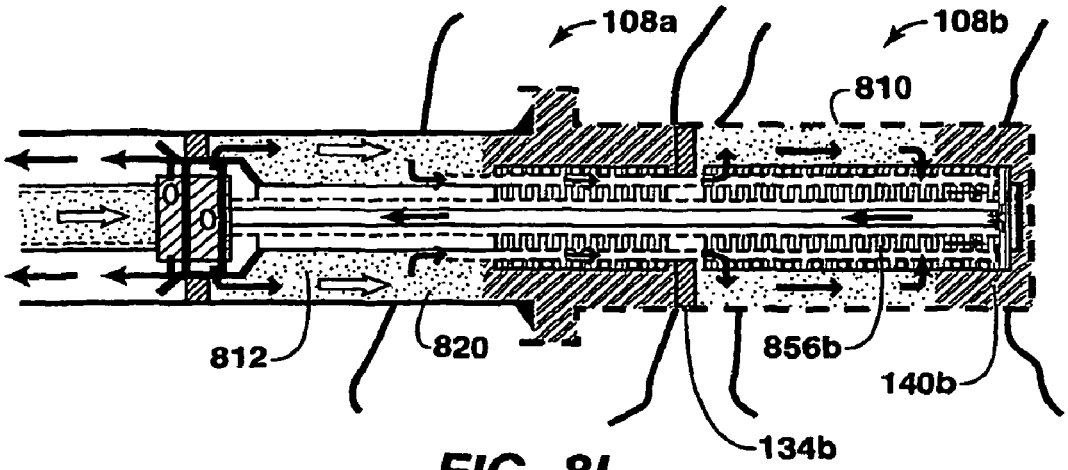
Figure 8M:
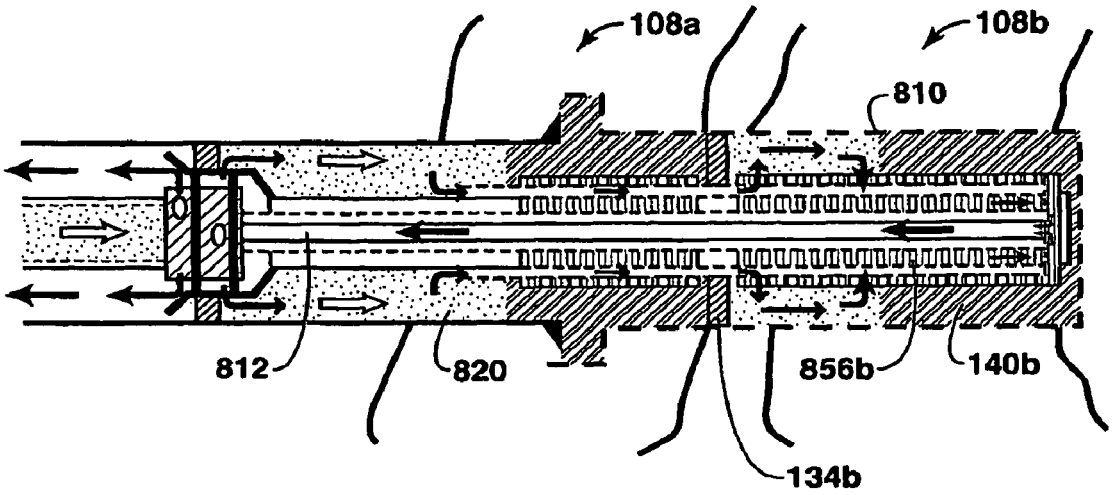
Figure 8N:
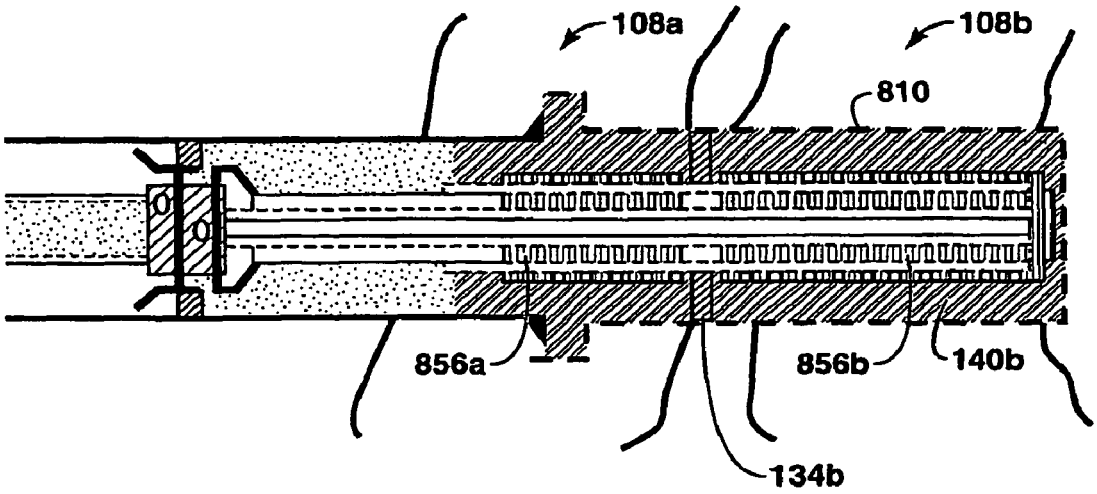

As a specific example, FIGS. 8A-8N illustrates exemplary embodiments of the installation process for a packer, sand control devices, and gravel packs. These embodiments, which may be best understood by concurrently viewing FIGS. 1, 2A-2B, 3A-3D, 4A-4D and 7, involve an installation process that runs sand control devices and a packer, which may be packer 300 or 400, in a conditioned drilling mud, such as a non-aqueous fluid (NAF), which may be a solids-laden oil-based fluid or a solids-laden water-based fluid. This process, which is a two-fluid process, may include similar techniques to the process discussed in International Patent Application No. WO 2004/079145, which is hereby incorporated by reference. However, it should be noted that this example is simply for exemplary purposes, as other suitable processes and equipment may also be utilized.

In FIG. 8A, sand control devices 350*a* and 350*b* and packer 134*b*, which may be one of packers discussed above, are run into the wellbore. The sand control devices 350*a* and 350*b* may include internal shunt tubes 352 disposed between base pipes 354*a* and 354*b* and sand screens 356*a* and 356*b*. These sand control devices 350*a* and 350*b* and packer 134*b* may be installed in a conditioned NAF 804 within the walls 810 of the wellbore. In particular, the packer 134*b* may be installed between the production intervals 108*a* and 108*b*. In addition, a crossover tool 802 with a washpipe 803 and packer 134*a* are lowered and set in the wellbore 114 on a drill pipe 806. The crossover tool 802 and packer 134*a* may be positioned within the production casing string 126. The conditioned NAF 804 in the wellbore may be conditioned over mesh shakers (not shown) before being placed within the wellbore to reduce any potential plugging of the sand control devices 350*a* and 350*b*.

In FIG. 8B, the packer 134*a* is set in the production casing string 126 above the intervals 108*a* and 108*b*, which are to be gravel packed. The packer 134*a* seals the intervals 108*a* and 108*b* from the portions of the wellbore 114 above the packer 134*a*. After the packer 134*a* is set, as shown in FIG. 8C, the crossover tool 802 is shifted into the reverse position and a carrier fluid 812 is pumped down the drill pipe 806 and placed into the annulus between the production casing string 126 and the drill pipe 806 above the packer 134*a*. The carrier fluid 812 displaces the conditioned drilling fluid, which may be an oil-based fluid, such as the conditioned NAF 804, in the direction indicated by arrows 814.

Next, in FIG. 8D, the crossover tool 802 is shifted into the circulating position, which may also be referred to as the circulating gravel pack position or gravel pack position. Carrier fluid 812 is then pumped down the annulus between the production casing string 126 and the drill pipe 806 pushing the Conditioned NAF 804 through the washpipe 803, out the sand screens 356*a* and 356*b*, sweeping the open-hole annulus between the sand screens 356*a* and 356*b* and the wall 810 of the wellbore, and through the crossover tool 802 into the drill pipe 806. The flow path of the carrier fluid 812 is indicated by the arrows 816.

In FIGS. 8E-8G, the interval is prepared for gravel packing. In FIG. 8E, once the open-hole annulus between the sand screens 356*a* and 356*b* and the wall 810 of the wellbore has been swept with carrier fluid 812, the crossover tool 802 is shifted to the reverse position. Conditioned NAF 804 is pumped down the annulus between the production casing string 126 and the drill pipe 806 to force the conditioned NAF 804 and carrier fluid 812 out of the drill pipe 806, as shown by the arrows 818. These fluids may be removed from the drill pipe 806. Then, the packer 134*b* is set, as shown in FIG. 8F. The packer 134*b*, which may be one of the packers 300 or 400, for example, may be utilized to isolate the annulus formed between the walls 810 of the wellbore and the sand screens 356*a* and 356*b*. While still in the reverse position, as shown in FIG. 8G, the carrier fluid 812 with gravel 820 may be placed within the drill pipe 806 and utilized to force conditioned NAF 804 up the annulus formed between the drill pipe 806 and production casing string 126 above the packer 134*a*, as shown by the arrows 822.

In FIGS. 8H-8J, the crossover tool 802 may be shifted into the circulating position to gravel pack the first interval 108*a*. In FIG. 8H, the carrier fluid 812 with gravel 820 begins to create a gravel pack within the production interval 108*a* above the packer 134*b* in the annulus between the walls 810 of the wellbore and the sand screen 356*a*. The fluid flows outside the sand screen 356*a* and returns through the washpipe 803 as indicated by the arrows 824. In FIG. 8I, the gravel pack 140*a* begins to form above the packer 134*b*, around the sand screen 356*a*, and toward the packer 134*a*. In FIG. 8J, the gravel packing process continues to form the gravel pack 140*a* toward the packer 134*a* until the sand screen 356*a* is covered by the gravel pack 140*a*.

Once the gravel pack 140*a* is formed in the first interval 108*a*, and the sand screens above the packer 134*b* are covered with gravel, the carrier fluid 812 with gravel 820 is forced through the shunt tubes and the packer 134*b*. The carrier fluid 812 with gravel 820 begins to create the second gravel pack 140*b* in FIGS. 8K-8N. In FIG. 8K, the carrier fluid 812 with gravel 820 begins to create the second gravel pack 140*b* within the production interval 108*b* below the packer 134*b* in the annulus between the walls 810 of the wellbore and the sand screen 356*b*. The fluid flows through the shunt tubes and packer 134*b*, outside the sand screen 356*b* and returns through the washpipe 803 as indicated by the arrows 826. In FIG. 8L, the gravel pack 140*b* begins to form below the packer 134*b* and around the sand screen 356*b*. In FIG. 8M, the gravel packing continues to grow the gravel pack 140*b* toward the packer 134*b* until the sand screen 356*b* is covered by the gravel pack 140*b*. In FIG. 8N, the gravel packs 140*a* and 140*b* are formed and the surface treating pressure increases to indicate that the annular space between the sand screens 356*a* and 356*b* and the walls of the wellbore 810 are gravel packed.

A specific example of an installation of the packers 502 and 504 is described below. To begin, the production interval is drilled to target depth and well back reamed to clean the wellbore. Open-hole logs may be sent to an engineer to review and identify a location in shale to set the first packer 502. The location of the first packer 502 may be positioned across a shale barrier that separates the predicted water/gas production sand and long term hydrocarbon producing interval. Then, a pre-drilled liner 508 with the first packer 502 may be run to the target depth. Accordingly, the first packer 502 may isolate the annulus between the shale section and the pre-drilled liner 508. Then, the sand control devices and second packer 504 may be run to the target depth. The second packer 504 isolates the annulus between the pre-drilled liner 508 and the sand control screens of the sand control device. Then, the gravel pack process may proceed similar to the discussion of FIGS. 8B-8N.

FIGS. 9A-9D are exemplary embodiments of the zonal isolation that may be provided by the packers described above in accordance with aspects of the present techniques. Accordingly, these embodiments may be best understood by concurrently viewing FIGS. 1, 3A-3D, 4A-4D and 5A-5C. In these embodiments, FIGS. 9A and 9B relate to process or system that utilizes the packers 300 or 400, while FIGS. 9C and 9D relate to process or system that utilizes the packers 502 and 504.

Figure 9A:
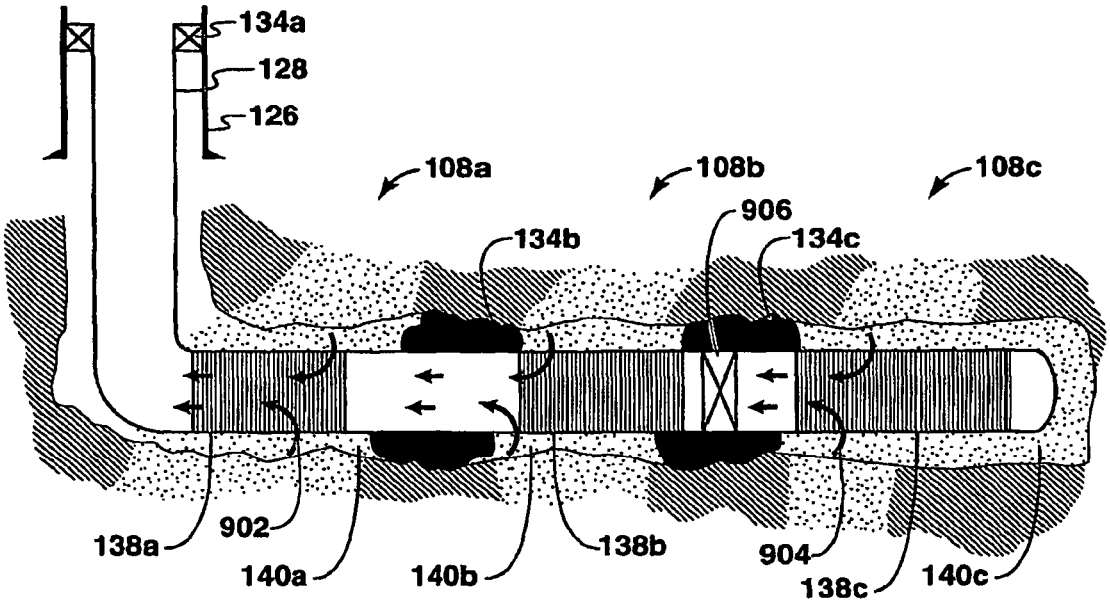
FIGS. 9A-9D are exemplary embodiments of the zonal isolation provided by the packers described above in accordance with aspects of the present techniques.
Figure 9B:
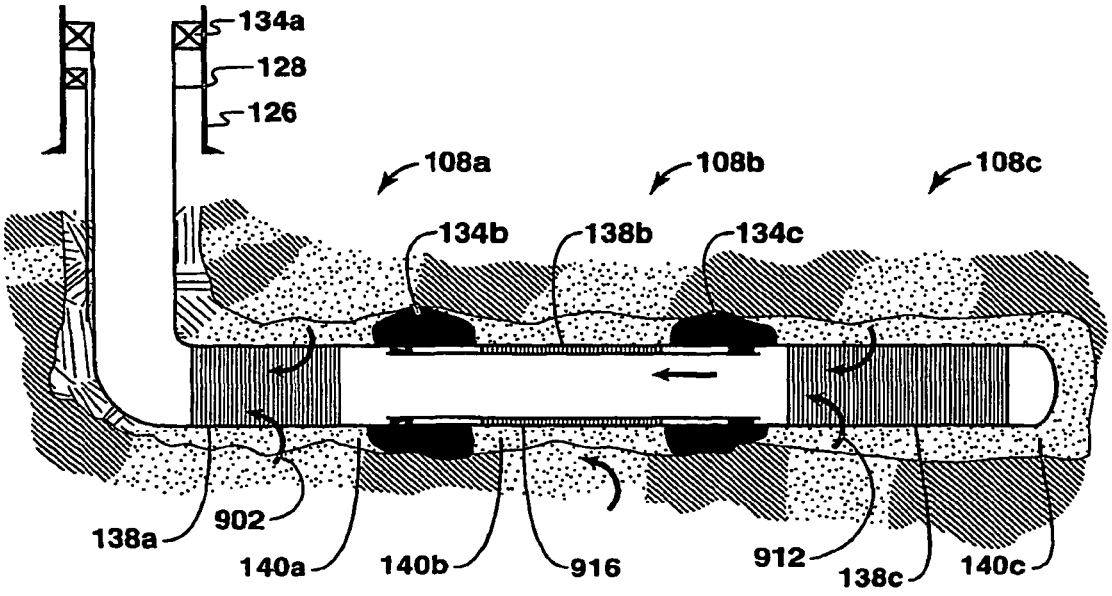

In FIGS. 9A-9B, sand control devices 138*a*-138*c* and gravel packs 140*a*-140*c* are placed within the wellbore 114 with packers 134*a*-134*c*, which may be one of packers discussed above. The sand control devices 138*a* and 138*b*, which may include internal shunt tubes (not shown) disposed between base pipes and sand screens, may be utilized to produce hydrocarbons from the respective intervals 108*a* and 108*b*, which may flow along the flow paths 902 and 904. In FIG. 9A, the interval 108*c* is producing water along the flow path 904. Accordingly, to isolate this interval 108*c*, a plug 906 may be installed within the base pipe at the location of the packer 134*c*. This plug 906 along with the packer 134*c* isolates the water producing interval from the other intervals 108*a* and 108*b*, which may continue to produce hydrocarbons. Similarly, in FIG. 9B, the interval 108*b* is producing water. To isolate the interval 108*b*, a straddle assembly 916 may be installed between packers 134*b* and 134*c* to isolate the water producing interval 108*b* from the other intervals 108*a* and 108*c* that are producing hydrocarbons along the path 912.

Figure 9C:
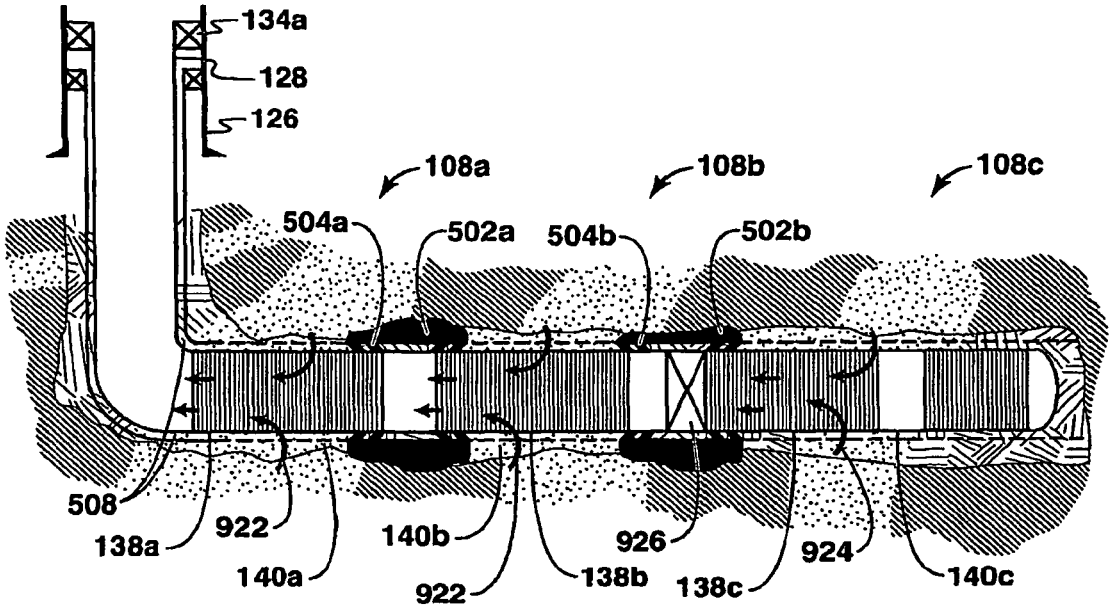
Figure 9D:
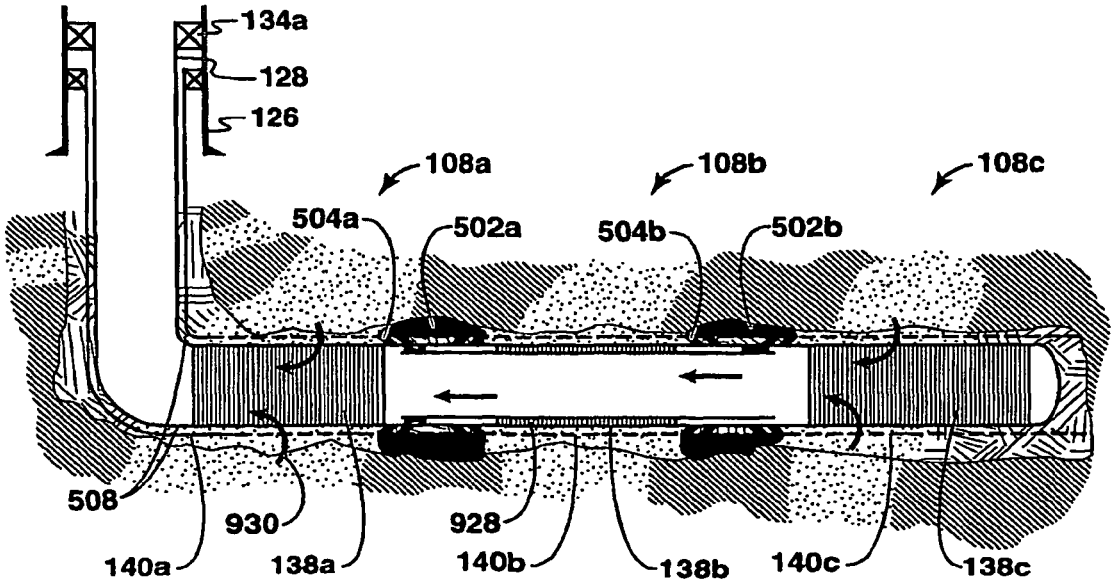

In FIGS. 9C-9D, sand control devices 138*a*-138*c* and gravel packs 140*a*-140*c* are placed within a liner 508 within the wellbore 114 with packers 502*a, b* and 504*a, b*. The sand control devices 138*a* and 138*b*, which may include internal shunt tubes, may be utilized to produce hydrocarbons from the respective intervals 108*a* and 108*b*, which may flow along the flow paths 922. In FIG. 9C, the interval 108*c* is producing water along the flow path 924. Accordingly, to isolate this interval 108*c*, a plug 926 may be installed within the base pipe at the location of the packers 602*b* and 504*b*. This plug 926 along with the packer 502*b* and 504*b* isolates the water producing portion from the other intervals 108*a* and 108*b*, which may continue to produce hydrocarbons. Similarly, in FIG. 9D, the interval 108*b* is producing water. A straddle assembly 928 may be installed between packers 502*a, b* and 504*a, b* to isolate the water producing interval 108*b* from the other intervals 108*a* and 108*c* that are producing hydrocarbons along the path 930.

As a specific example of isolation techniques, water production may be determined to be present at the toe of a deviated wellbore. This location may be determined by conducting a PLT survey to confirm the source of the water production. Then, a wireline or coil tubing set plug, which may include a lock or slip type mandrel and an equalizing sub, may be installed to isolate the water production interval. The plug may be run in a non-selective mode as the nipple profile (if included as part of the packer assembly) in the packer (e.g. a cup type packer, such as, for example, MZ PACKER™ (Schlumberger), a swellable packer, such as, for example, E-ZIP™) is typically the smallest in the completion string. Also, it should be noted that a tractor may be utilized for deviations over 65 degrees if wireline is the selected workstring type. Once set, the wireline or coil tubing unit may be rigged down and production resumed.

As another example, the water may be determined as being produced from the heel of the deviated wellbore. Again, in the example, the source of the water production may be confirmed by conducting a PLT survey. Then, coil tubing may be rigged up and a straddle assembly may be installed to adequately isolate the water producing interval. The straddle assembly may include a seal stinger, no-go locator, flush joint tubing and a slip or lock mandrel type hanger. The straddle assembly may be made up to the coil tubing work string and run in hole to seat the stinger seals inside the isolation packer. The flush joint tubing isolates the water producing interval and the hanger locks the full assembly in place. Once in place, the coil tubing unit is rigged down and production resumed.

Figure 10A:
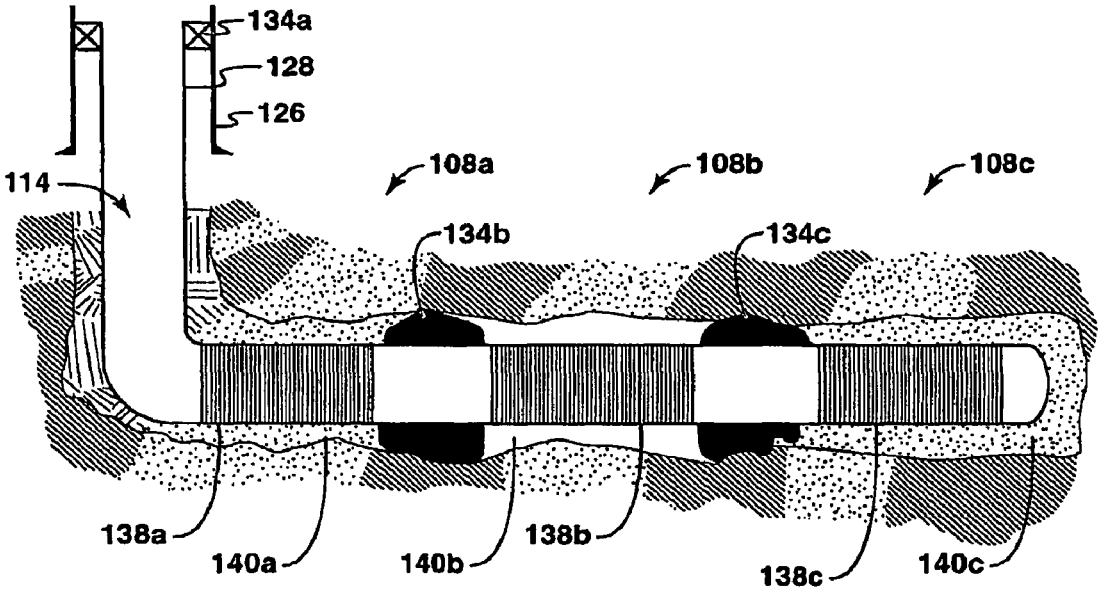
FIGS. 10A-10B are exemplary embodiments of the different types of gravel packs utilized with the zonal isolation provided by the packers described above in accordance with aspects of the present techniques.
Figure 10B:
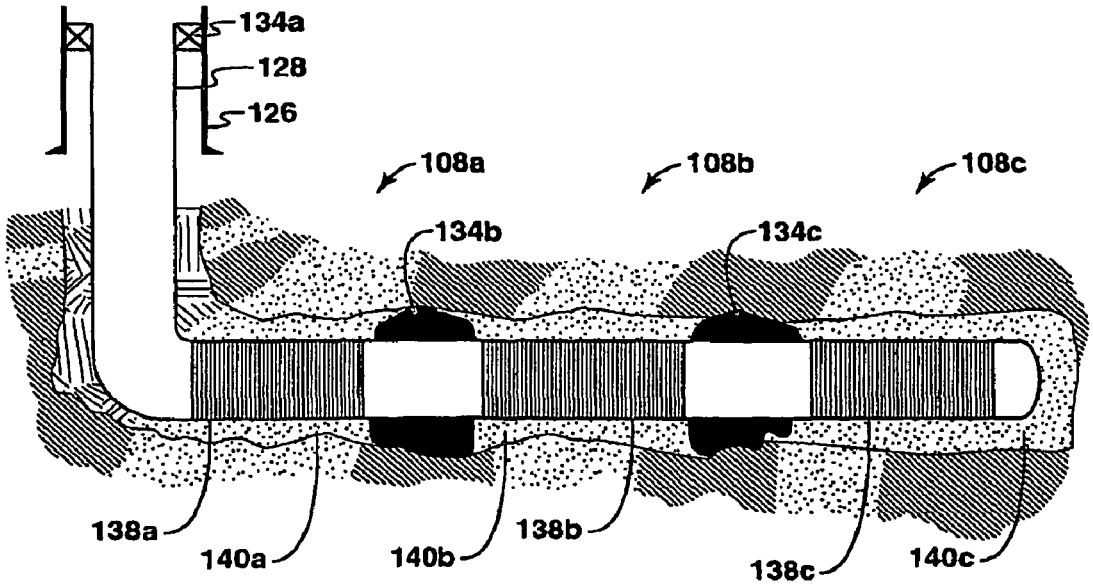

In addition, by utilizing a packer to isolate various intervals, different flexibility is provided with the placement of gravel packs in some intervals and even the type of gravel. For instance, FIGS. 10A-10B are exemplary embodiments of the different types of gravel packs utilized with the zonal isolation provided by the packers described above in accordance with aspects of the present techniques. Accordingly, these embodiments may be best understood by concurrently viewing FIGS. 1, 3A-3D, 4A-4D, 5A-5C and 9A-9D.

In FIGS. 10A-10B, the sand control devices 138*a*-138*c* are placed within the wellbore 114 with packers 134*b* and 134*c*. The sand control devices 138*a*-138*c*, which may include internal shunt tubes, may be utilized to produce hydrocarbons from the respective intervals 108*a*-108*c*. In FIG. 10A, the intervals 108*a* and 108*c* are packed to form gravel packs 140*a* and 140*c* through internal shunt tubes. The internal shunt tubes in sand control device 138*b* may be plugged and are not in fluid communication with wellbore 114. As a result, no gravel pack 140*b* is formed within the interval 108*b* because gravel does not enter the interval 108*b* due to the isolation provided by packers 134*b* and 134*c*. Even with the isolation, hydrocarbons are produced from intervals 108*a*-108*c* through sand control devices 138*a*-138*c*. In this example, a gravel pack 140*b* is not created in interval 108*b* due to the high sand quality in this interval, which may decrease well productivity. Or, a gravel pack is unnecessary due to high sand strength in interval 108*b*. Similarly, in FIG. 10B, gravel packs 140*b* and 140*c* are placed with internal shunts through direct shunt pumping. There is no fluid communication with the internal shunt tubes in sand control device 138*a*, which may be plugged. Gravel pack 140*a* is installed using conventional gravel pack techniques above the packer 134*b*. The gravel size in gravel pack 140*a* may be different than the gravel sizes in gravel packs 140*b* and 140*c* to improve well performance. As such, this zonal isolation provides flexibility in the placement of gravel packs as well as the type of gravel placed within the well.

Figure 11A:
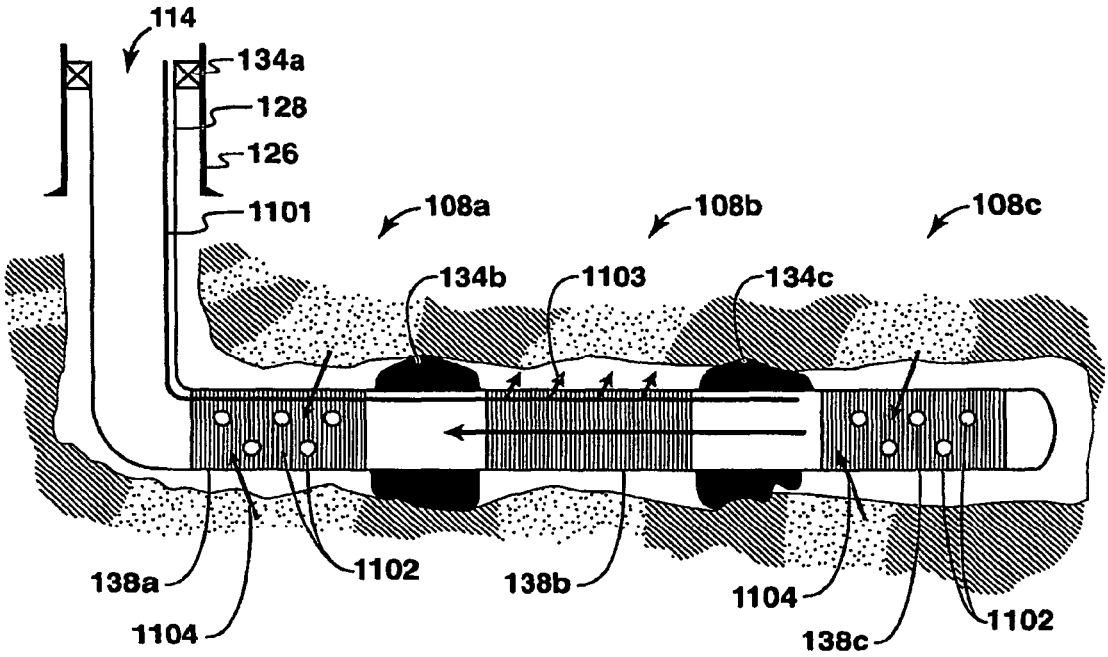
FIGS. 11A-11C are exemplary embodiments of the different types of flow through the zonal isolation provided by the packers described above in accordance with aspects of the present techniques.
Figure 11B:
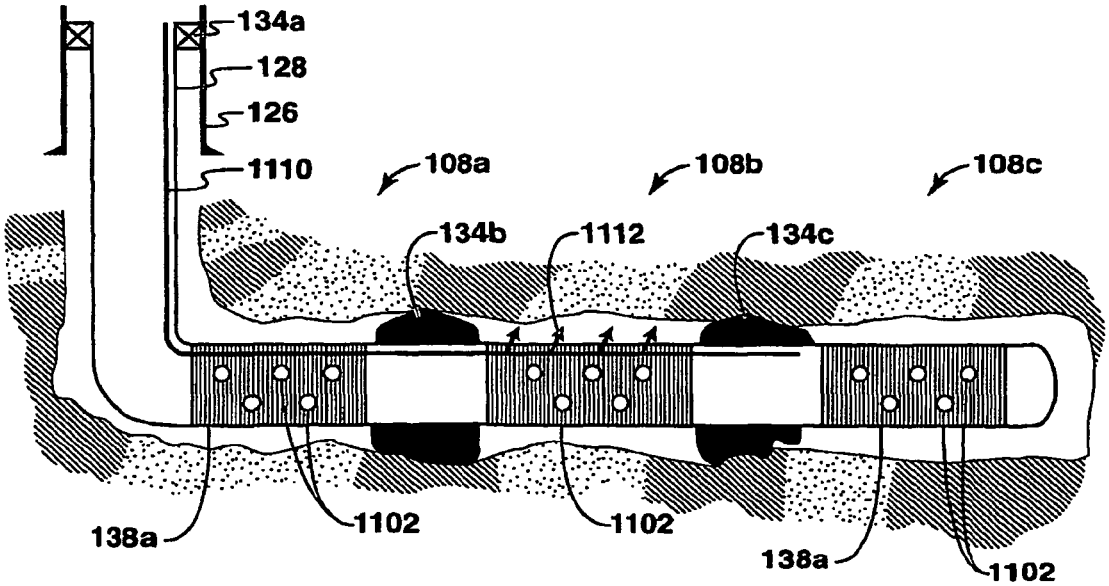
Figure 11C:
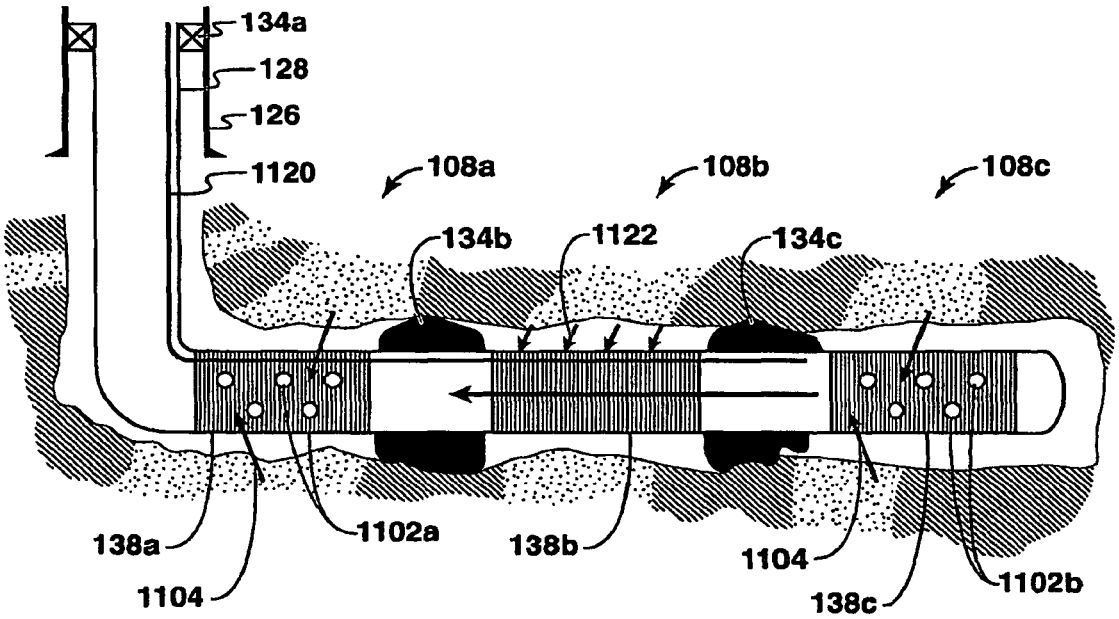

Further, it should be noted that the present techniques may also be utilized for injection and treatment of a well. For instance, during well injection, the shunt tubes and flow through the packers may function similar to well production, but provide flow in different directions. Accordingly, the packers may be configured to provide specific functionalities for an injection well or may be designed to operate as both an injection and production well. Accordingly, FIGS. 11A-11C are exemplary embodiments of the different types of flow through the zonal isolation provided by the packers described above in accordance with aspects of the present techniques. Accordingly, these embodiments may be best understood by concurrently viewing FIGS. 1, 3A-3D, 4A-4D, 5A-5C and 9A-9D.

In FIG. 11A, an internal shunt tube 1101 is in fluid communication with interval 108*b* to provide an injection fluid into the interval 108*b*. The injection fluid, which may be water, gas, or hydrocarbon, is injected into the interval 108*b* in the direction indicated by the arrows 1103. The injection of these fluids may be performed through direct shunt pumping. The injected fluids do not enter intervals 108*a* and 108*c* because the packers 134*b* and 134*c* provide isolation in wellbore 114. While injecting into interval 108*b*, hydrocarbons are produced through basepipe perforations 1102 in sand control devices 138*a* and 138*c* in the direction of the arrows 1104. Because the sand control device 138*b*, may be blocked with a straddle assembly, as noted above, the resulting injected fluid may remain in interval 108*b*.

In FIG. 11B, the internal shunt tube 1110 is in fluid communication with interval 108*b* to provide a treatment fluid into the interval 108*b*. The treatment fluid, which may be used to stimulate a well, is injected into interval 108*b* in the direction indicated by arrows 1112. Again, the treatment fluid may be provided to the interval 108*b* through direct shunt pumping techniques. Injected fluid indicated by arrows 1112 does not enter intervals 108*a* and 108*c* due to the isolation in wellbore 114 by packers 134*b* and 134*c*. In this example, hydrocarbons are produced after treating operations through basepipe perforations 1102 in sand control devices 138*a*-138*c*. Accordingly, the flow from the secondary flow paths of the sand control devices are commingled with flow from the primary flow paths of the sand control devices.

One example of such a treatment technique is the removal of a filter cake. In this example, interval 108*b* includes a filter cake and the sand control devices 138*a*-138*c* are positioned in the wellbore 114. The filter cake removal treatment may be mechanical and/or chemical and may be accomplished before or after gravel packing operations. More specifically, the filter cake treatment fluid is pumped directly into the secondary flow path, which serves to deliver the filter cake treatment fluid to the sand face of the interval 108*b* indicated by arrows 1112. The treatment may be pumped with or without returns. A preferred embodiment of this treatment technique utilizes alternate path technology incorporating shunt tubes 1110 with nozzles (not shown) that are affixed to and extend the length of the sand control screen 138*b*. Mechanical removal may be accomplished by directing the treatment from the nozzles towards the formation face to agitate the filter cake, this may involve high rate pumping or the apparatus may involve specially designed nozzles or mechanical agitators. Chemical removal may involve the use of acids, solvents, or other compounds.

In FIG. 11C, the internal shunt tube 1120 is in fluid communication with interval 108*b* to provide a dual completion approach for the well. Production fluid indicated by arrows 1122 is produced into the shunt tube through openings, such as perforations or slots. In this example, the production fluids are produced from intervals 108*a* and 108*c* through the perforations 1102 in the basepipe of sand control devices 138*a* and 138*c* along the path indicated in the arrows 1104. Sand control device 138*b* may be blocked by a straddle assembly or have basepipe perforations blocked to prevent commingling of the fluids from the intervals 108*a*-108*c*. As a result, the produced fluids from the interval 108*b* through the internal shunt tube 1120 may be produced separately from fluids in the intervals 108*a* and 108*c* because the packers 134*b* and 134*c* isolate the different intervals 108*a*-108*c*. Also, the secondary flow paths may be controlled separately at surface.

As an alternative embodiment of the packer 400, different geometric patterns may be utilized for the support members 418 to form partitions, compartments, and baffles that manage the flow of fluids within packer 400. As noted above, under the present techniques, support members 418 are utilized to form an opening 420 between the sleeve and the base pipe. These support members 418 may be configured to provide redundancy flow paths or baffling (staggering) within the packer 400. For example, the support members 418 may be configured to form two openings, three openings, any number of opening up to the number of shunt tubes on the sand control device 138, or more openings than shunt tubes on the sand control device 138. In this manner, the sand control device 138 and the packer 400 may utilize the shunt tubes for producing hydrocarbons or may utilize these different shunt tubes to provide various fluids or paths through the wellbore 114. Thus, the support members 418 may be utilized to form channels having various geometries.

In addition, it should be noted that the shunt tubes utilized in the above embodiments may be external or internal shunt tubes that have various geometries. The selection of shunt tube shape relies on space limitations, pressure loss, and burst/collapse capacity. For instance, the shunt tubes may be circular, rectangular, trapezoidal, polygons, or other shapes for different applications. Examples of shunt tubes include ExxonMobil's ALLPAC® and AIIFRAC®.

Moreover, it should be appreciated that the present techniques may also be utilized for gas breakthroughs as well. For example, gas breakthrough may be monitored in block 614 of FIG. 6. If gas breakthrough is detected, the gas producing interval may be isolated in block 620. The gas may be isolated by utilizing the techniques described above in at least FIGS. 9A-9D.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What we claim is:

1. A system associated with production of hydrocarbons comprising:

a wellbore utilized to produce hydrocarbons from a subsurface reservoir;

a production tubing string disposed within the wellbore;

a plurality of sand control devices coupled to the production tubing string and disposed within an open-hole section of the wellbore, wherein each of the plurality of sand control devices comprises at least one shunt tube;

at least one packer coupled between two of the plurality of sand control devices, wherein the at least one packer is configured to provide at least one flow path through the at least one packer and between the shunt tubes of two of the plurality of sand control devices, the at least one packer including a manifold region in fluid communication with the shunt tubes of each of the two of the plurality of sand control devices, whereby the manifold region commingles and redistributes flow among the shunt tubes and wherein the at least one packer is configured to substantially prevent fluid flow in at least a portion of an annulus between the tubular member and a wall of a wellbore;

a first gravel pack disposed at least partially around at least one of the plurality of sand control devices upstream from the at least one packer; and a second gravel pack disposed at least partially around at least one of the plurality of sand control devices downstream from the at least one packer, wherein at least one shunt tube of each of the plurality of sand control devices and at least one flow path through the at least one packer are configured to dispose the second gravel pack.

2. The system of claim 1 wherein the at least one packer comprises:

a tubular member having a central opening for fluid flow through the tubular member;

a packer element disposed around the tubular member, wherein the packer element is configured to isolate a portion of an annulus between the tubular member and a wall of the wellbore; and at least one jumper tube external to the tubular member and in contact with the packer element.

3. The system of claim 1 wherein the at least one packer comprises:

a tubular member having a first opening for fluid flow through the interior of the tubular member;

a sleeve disposed around the tubular member, wherein a second opening is formed between the tubular member and the sleeve;

a plurality of support members disposed between the tubular member and the sleeve; and a packer element disposed around the sleeve, wherein the packer element is configured to substantially prevent fluid flow outside the sleeve.

4. The system of claim 3 wherein a plurality of channels are formed in the second opening by the sleeve, the tubular member, and the plurality of support members.

5. The system of claim 1 wherein each of the plurality of sand control devices has a primary flow path isolated from the wellbore by a filter medium and wherein the at least one shunt tube provides a secondary flow path; and wherein the at least one packer provides a primary flow path in fluid communication with the primary flow path of at least one of the plurality of sand control devices and a secondary flow path in fluid communication with the at least one shunt tube of at least one of the plurality of sand control devices through a manifold region that commingles and redistributes flow within the secondary flow path of the at least one packer.

6. The system of claim 5 wherein the shunt tubes are disposed external to the filter medium.

7. The system of claim 5 wherein the shunt tubes are disposed internal to the filter medium.

8. The system of claim 1 wherein the expansion element comprises at least one of a swellable element, an inflatable element, and a cup-type packer element.

9. The system of claim 1 wherein the expansion element is actuated by one or more of hydraulic actuation, mechanical actuation, and hydrostatic pressure actuation.

10. The system of claim 1 wherein the expansion element expands in the presence of at least one of drilling fluid, production fluid, completion fluid, and any combination thereof.

11. A method of producing hydrocarbons from a well comprising:

disposing sand control devices and at least one packer within a wellbore adjacent to a subsurface reservoir, wherein each of the sand control devices includes at least one shunt tube and each of the at least one packer includes a primary and secondary flow path, wherein the secondary flow path of the at least one packer is in fluid communication with the at least one shunt tube of the sand control devices, the at least one packer including a manifold region in fluid communication with the shunt tubes of each of two of the plurality of sand control devices, whereby the manifold region commingles and redistributes flow among the shunt tubes and wherein the at least one packer is configured to substantially prevent fluid flow in at least a portion of an annulus between the tubular member and a wall of a wellbore;

setting the at least one packer within the open-hole section;

gravel packing the sand control devices in an interval of the subsurface reservoir downstream from the at least one packer by passing a carrier fluid having gravel through the secondary flow path of the at least one packer; and producing hydrocarbons from the wellbore by passing hydrocarbons through the sand control devices.

12. The method of claim 11 comprising gravel packing the sand control devices in an interval of the subsurface reservoir upstream of the at least one packer.

13. The method of claim 12 comprising:

conditioning a drilling fluid utilized to access a subsurface formation via the wellbore, wherein the sand control devices and the at least one packer are disposed in the wellbore in the conditioned drilling fluid;

displacing the conditioned drilling fluid adjacent to the sand control devices and the at least one packer with a carrier fluid prior to setting the packer; and gravel packing the intervals of the wellbore with the carrier fluid having gravel.

14. The method of claim 13 wherein the conditioned drilling fluid is a solids-laden oil-based fluid.

15. The method of claim 13 wherein the conditioned drilling fluid is a solids-laden water-based fluid.

16. The method of claim 13 wherein the carrier fluid comprises a fluid viscosified with one or more of HEC polymer, xanthan polymer, and visco-elastic surfactant.

17. The method of claim 13 wherein the carrier fluid has rheology and sand carrying capacity adapted to gravel packing the intervals of the wellbore utilizing the shunt tubes of the sand control devices.

18. The method of claim 12 wherein the at least one packer comprises:

a tubular member having a first opening to provide the primary flow path for fluid flow through the tubular member;

a sleeve disposed around the tubular member wherein a second opening is formed between the tubular member and the sleeve;

a plurality of support members disposed between the tubular member and the sleeve; and a packer element disposed around the sleeve, wherein the packer element is configured to substantially prevent fluid flow outside the sleeve.

19. The method of claim 11 wherein the at least one packer comprises:

a tubular member having a central opening to provide the primary flow path through the packer;

a packer element disposed around the tubular member, wherein the packer element is configured to separate a portion of an annulus between the tubular member and a wall of a wellbore; and at least one jumper tube external to the tubular member and in contact with the packer element to provide the secondary flow path through the packer.

20. The method of claim 11 wherein producing hydrocarbons comprises producing hydrocarbons from a first interval of the wellbore through a primary flow path of the sand control devices and through the primary flow path of the packer and producing hydrocarbons from a second interval of the wellbore isolated from the first interval by the packer through the secondary flow paths of the packer and the shunt tubes of the sand control devices.

21. A method associated with production of hydrocarbons comprising:

providing a plurality of sand control devices having a primary flow path through the sand control devices and having shunt tubes, wherein each of the shunt tubes forms a secondary flow path;

coupling a packer between two of the plurality of sand control devices, wherein the packer comprises a tubular member, a secondary flow path, and an expansion element disposed around the tubular member wherein the expansion element is configured to separate a portion of an annulus between the tubular member and a wall of a wellbore, wherein the tubular member is configured to provide a primary flow path in communication with the primary flow path of the sand control devices, and wherein the secondary flow path extends through the packer and is in fluid communication with the shunt tubes of the plurality of sand control devices, the at least one packer including a manifold region in fluid communication with the shunt tubes of each of two of the plurality of sand control devices, whereby the manifold region commingles and redistributes flow among the shunt tubes and wherein the expansion element is configured to substantially prevent fluid flow in at least a portion of an annulus between the tubular member and a wall of a wellbore;

disposing the plurality of sand control devices and the packer within a wellbore; and producing hydrocarbons from the wellbore by passing hydrocarbons through the sand control devices.

* * * * *